US009140008B2

(12) United States Patent
Beaty et al.

(10) Patent No.: US 9,140,008 B2
(45) Date of Patent: Sep. 22, 2015

(54) MULTI-LAYERED CLADDING FRAME SYSTEM

(71) Applicant: MOTO Extrusions, Inc., Capitola, CA (US)

(72) Inventors: Brent Beaty, Soquel, CA (US); Daniel Gomez, Aptos, CA (US); Daniel Townsend, Aptos, CA (US)

(73) Assignee: MOTO Extrusions, Inc., Capitola, CA (US)

( * ) Notice: Subject to any disclaimer, the term of this patent is extended or adjusted under 35 U.S.C. 154(b) by 0 days.

(21) Appl. No.: 14/279,096

(22) Filed: May 15, 2014

(65) Prior Publication Data

US 2015/0052840 A1 Feb. 26, 2015

Related U.S. Application Data

(63) Continuation-in-part of application No. 14/260,248, filed on Apr. 23, 2014.

(60) Provisional application No. 61/854,368, filed on Apr. 23, 2013.

(51) Int. Cl.
*E04B 2/88* (2006.01)
*E04B 2/60* (2006.01)
(Continued)

(52) U.S. Cl.
CPC ... *E04B 2/60* (2013.01); *E04B 2/02* (2013.01); *E04B 2/16* (2013.01); *E04B 2/58* (2013.01); *E04C 3/02* (2013.01); *E04F 13/0866* (2013.01); *E04F 13/24* (2013.01); *E06B 1/34* (2013.01);
(Continued)

(58) Field of Classification Search
CPC ..... E04B 2/96; E04B 3/5427; E04B 2/88; E04B 2/60
USPC ..... 52/483.1, 235, 204.1, 209, 217, 219, 52/204.53, 204.5, 204.55, 204.591, 52/204.593, 204.6, 474, 302.1, 302.3, 52/716.1, 716.4, 717.01, 718.01, 718.04, 52/717.06, 506.05, 506.06, 463, 468, 479, 52/712, 714, 287.1, 288.1, 653.2, 656.4, 52/656.5, 489.1, 489.2, 511, 513, 702, 715
See application file for complete search history.

(56) References Cited

U.S. PATENT DOCUMENTS 2,803,858 A * 8/1957 Rader ..... 52/464
3,421,281 A * 1/1969 Harris ..... 52/483.1
(Continued)

OTHER PUBLICATIONS

Knight Wall Systems, Inc., Code Compliant Continuously Insulated Exrerior Wall Assemlby: Thermal & Air Barrier Wall System With a Rain Screen Attachment System (verticla members only) for Exterior Siding or Cladding Panels, Performance Guide Specification, Jun. 19, 2013, 18 pp., Deer Park, WA.
(Continued)

*Primary Examiner* — Beth Stephan
(74) *Attorney, Agent, or Firm* — John G. Fischer/Esq.; Jaspal S. Hare, Esq.; Scheef & Stone, L.L.P.

(57) ABSTRACT

The present invention provides a multi-layered framing system for securing cladding to an exterior wall having exterior insulation. The framing system provides horizontal elements positioned across the exterior insulation, wherein the horizontal elements are secured to studs within the wall using fasteners. Vertical elements are secured to the horizontal elements. Then panels of cladding are secured to the vertical elements.

17 Claims, 19 Drawing Sheets

(51) Int. Cl.

| | |
|---|---|
| ***E04B 2/02*** | (2006.01) |
| ***E04C 3/02*** | (2006.01) |
| ***E04F 13/08*** | (2006.01) |
| ***E04F 13/24*** | (2006.01) |
| ***E06B 1/34*** | (2006.01) |
| ***E06B 1/36*** | (2006.01) |
| ***E04B 2/16*** | (2006.01) |
| ***E04B 2/58*** | (2006.01) |
| *E06B 1/68* | (2006.01) |

(52) U.S. Cl.

CPC ..... *E06B 1/36* (2013.01); *E04B 2002/0232* (2013.01); *E04B 2002/0256* (2013.01); *E06B 1/68* (2013.01)

(56) References Cited

U.S. PATENT DOCUMENTS

| | | | | |
|---|---|---|---|---|
| 3,534,516 | A * | 10/1970 | Cooper | 52/481.2 |
| 3,956,861 | A | 5/1976 | Rasmussen | |
| 3,998,016 | A | 12/1976 | Ting | |
| 4,910,938 | A * | 3/1990 | McGee | 52/481.2 |
| 4,999,961 | A | 3/1991 | McNary | |
| 5,065,557 | A * | 11/1991 | Laplante et al. | 52/235 |
| 5,220,759 | A * | 6/1993 | Hossli | 52/235 |
| 5,222,343 | A | 6/1993 | Anderson | |
| 5,542,222 | A | 8/1996 | Wilson et al. | |
| 5,678,383 | A | 10/1997 | Danielewicz | |
| 5,687,524 | A * | 11/1997 | Ting | 52/461 |
| 5,893,245 | A | 4/1999 | Sekiguchi et al. | |
| 5,974,748 | A | 11/1999 | Sciuga et al. | |
| 6,226,947 | B1 * | 5/2001 | Bado et al. | 52/483.1 |
| 6,553,732 | B2 | 4/2003 | Shaw | |
| 6,988,344 | B1 * | 1/2006 | Krueger | 52/464 |
| 7,191,570 | B1 * | 3/2007 | Eaton | 52/506.09 |
| 8,033,066 | B2 * | 10/2011 | Griffiths | 52/235 |
| D662,805 | S | 7/2012 | Macdonald et al. | |
| 8,336,273 | B2 * | 12/2012 | Enns | 52/588.1 |
| 8,429,866 | B2 | 4/2013 | Knight et al. | |
| 8,769,901 | B2 * | 7/2014 | Todd et al. | 52/483.1 |
| 2004/0074175 | A1 | 4/2004 | Tierney | |
| 2005/0060950 | A1 * | 3/2005 | Hauschildt et al. | 52/235 |
| 2005/0262782 | A1 | 12/2005 | Harrison et al. | |
| 2006/0143996 | A1 | 7/2006 | Alvarado | |
| 2009/0272060 | A1 | 11/2009 | Lucchesi | |
| 2010/0031597 | A1 * | 2/2010 | Baek | 52/489.1 |
| 2010/0199585 | A1 | 8/2010 | Stevens et al. | |
| 2010/0229484 | A1 * | 9/2010 | Carolan et al. | 52/302.1 |
| 2010/0251647 | A1 * | 10/2010 | Enns | 52/302.1 |
| 2012/0137610 | A1 | 6/2012 | Knight et al. | |
| 2012/0174503 | A1 | 7/2012 | Milostic | |
| 2012/0297725 | A1 * | 11/2012 | Anastasi | 52/705 |
| 2012/0317909 | A1 | 12/2012 | MacKenzie | |
| 2013/0291465 | A1 | 11/2013 | Resso | |
| 2014/0026510 | A1 | 1/2014 | Kubassek et al. | |

OTHER PUBLICATIONS

Knight Wall Systems, Inc., Code Compliant Continuously Insulated Exterior Wall Assembly: Thermal & Air Barrier Wall System With a Rain Screen Attachment System (vertical + horizontals) for Exterior Siding or Cladding Panels, Performance Guide Specification, Jun. 19, 2013, 18 pp., Deer Park, WA.

Dow—Knight Wall Systems, Inc., CI-Systems Face Fastened Panels Thermax™ Wall System Guide Detail, May 25, 2012, 18 pp., Deer Park, WA.

Dow—Knight Wall Systems, Inc., CI-System (CI-SidingRail) with Fiber Cement Lap Siding Thermax™ Wall System Guide Detail, Jun. 27, 2012, 9 pp., Deer Park, WA.

Dow—Knight Wall Systems, Inc., CI-System (CI-SidingRail) D.A. F.S on Cement Board Thermax™ Wall System Guide Detail, Jun. 27, 2012, 16 pp., Deer Park, WA.

Knight Wall Systems, Inc., Knight CI-System Rain Screen Attachment (vertical members only) Assembly Requirements & Guide Details, Jul. 31, 2013, 18 pp., Deer Park, WA.

Knight Wall Systems, Inc., Knight CI-System Rain Screen Attachment (vertical + horizontal members) Assembly Requirements & Guide Details, Jul. 31, 2013, 18 pp., Deer Park, WA.

Nelson, Brian, Panel Attachment & The Energy Code: How to Meet & Exceed the Energy Code With Exterior Mineral Fiber Insulation, white paper, Jul. 2013, 3 pp., Knight Wall Systems, Inc., Deer Park, WA.

Dow—Knight Wall Systems, Inc., CI-System for ASHRAE Compliant Continuous Insulation: R-Value = Real Value, Internet printout, May 1, 2014, 1 pg., Deer Park, WA.

Northclad Rainscreen Solutions, The AL Series details, Internet printout, 2009, 21 pp., Everett, WA.

Northclad Rainscreen Solutions, The EF Series details, Internet printout, 2009, 19 pp., Everett, WA.

American Fiber Cement Corp., Architectural Panels, Installation Guidelines, Aluminum Profiles with Rivets, Jun. 2011, 8 pp., Littleton, CO.

Allface Befestigungstechnologie GmbH & CoKG, Smart Fixing Systems, Feb. 2011, brochure, 16 pp., Leobersdorf, Austria.

Allface Befestigungstechnologie GmbH & CoKG, Smart Fixing Systems, company brochure, Nov. 2006, 4 pp., Leobersdorf, Austria.

Allface Befestigungstechnologie GmbH & CoKG, System Specifications, Apr. 2014, 28 pp., Leobersdorf, Austria.

Allface Befestigungstechnologie GmbH & CoKG, Smart Fixing Systems, Projekt-Info, Apr. 2014, 1 p., Leobersdorf, Austria.

Allface Befestigungstechnologie GmbH & CoKG, Systems Thinking, brochure, Sep. 2008, 8 pp., Leobersdorf, Austria.

Eurofox Facade Technology, A structured approach to facades, brochure, Ed. 2007, 52 pp., Lanzenkirchen, Austria.

Eurofox Facade Technology, brochure, Jul. 2011, 88 pp., Lanzenkirchen, Austria.

Eurofox Facade Technology, HILTI, FLA-h-100, Aluminum Support System for Rainscreen Cladding System for the Visible Attachment Fixed by Rivets, brochure, Jun. 2012, 21 pp., Lanzenkirchen, Austria.

Dow-Knight Wall Systems, Inc., CI-System and LEED, brochure, May 2011, 4 pp., Deer Park, WA.

Dow-Knight Wall Systems, Inc., CI-System Installation Procedures, brochure, May 2014, 6 pp., Deer Park, WA.

Dow-Knight Wall Systems, Inc., CI-System for ASHRAE-Compliant Continuous Insulation: R-Value Equals Real Value, brochure, Jul. 2012, 2 pp., Deer Park, WA.

Northclad Rainscreen Solutions, AL Series Aluminum Panel System, installation notes, Internet printout, 2009, 5 pp., Everett, WA.

Northclad Rainscreen Solutions, Go Modular with NorthClad Rectangular Aluminum Panel System, Internet printout, 2009, 2 pp., Everett, WA.

* cited by examiner

MULTI-LAYERED CLADDING FRAME SYSTEM

This application is a continuation-in-part of U.S. application Ser. No. 14/260,248, filed Apr. 23, 2014, which claims the benefit of U.S. Provisional Application No. 61/854,368, filed Apr. 23, 2013, each of which is hereby incorporated by reference in its entirety.

TECHNICAL FIELD

The present invention generally relates to a multi-layer framing system for supporting cladding.

BACKGROUND

Cladding the exterior and interior of residential and commercial buildings is gaining popularity. Exterior cladding may include a rain screen to protect the interior elements. Installation of cladding requires a framing system mounted to typically a wall of a structure, but may also be mounted to a roof, soffit, ceiling, floor, etc. The cladding is attached to the framing system. The framing system is typically made from galvanized metal. However, galvanized metal has many drawbacks.

One disadvantage is that galvanized metal cannot be used in coastal areas or areas of high moisture as the galvanized coating is insufficient to resist corrosion in these regions. Another disadvantage is that galvanized metal is difficult to cut and drill, which increases the cost and quality of the installation. Another disadvantage is that galvanized metal parts very rarely true, which requires additional labor to level components. Another disadvantage is that galvanized metal parts should be resealed after cutting or drilling to restitute the removed surface coating. Another disadvantage of conventional framing systems is that they normally provide a single-type of framing element, which must be cut and positioned to fit the geometric differences of the several structures and features (e.g., windows, doors, soffits, and corners) found on modern buildings. This one size fits all approach has proven inadequate and further increases the difficulty and cost of installation.

Another disadvantage of conventional cladding is that it fails to position the frames of the windows flush with the cladding. Windows are not normally perfectly aligned. When conventional cladding is applied, the misalignment of windows is magnified and more noticeable and thus aesthetically unpleasing. Often the window frame has a different offset than the cladding, which is also aesthetically unpleasing.

Today, there is a growing need for the use of exterior insulation in combination with exterior cladding. In a typical commercial building, the exterior walls of the building comprise vertical, metal studs. A sheathing layer is attached to the exterior of the metal studs. A water resistant barrier (WRB) may be placed over the sheathing layer. Then, a layer of vertical elements are aligned with the vertical metal studs and secured to the sheathing layer using fasteners that penetrate the sheathing layer and anchor into the metal studs. Exterior insulation is then installed over the sheathing layer and between the vertical elements. A layer of horizontal elements may be secured over the vertical elements. Lastly, cladding is secured to the horizontal elements or directly to the vertical elements when horizontal elements are not used.

Such systems have many disadvantages. One disadvantage is that the horizontal elements (which are made from metal) protrude through the exterior insulation. This creates thermal bridges that transmit heat between the outside environment and the interior of the building. These thermal bridges drastically decrease the effectiveness of the exterior insulation and thus reduce the overall energy efficiency of the building. Furthermore, such systems do not comply with more stringent building codes that require "continuous exterior insulation," i.e., exterior insulation that is not penetrated by any sub-framing element.

Others have attempted to solve the problem of thermal bridging by attaching the framing elements to clips that penetrate the exterior insulation. Even though the use of clips reduces thermal bridging, the clip systems have many disadvantages. One disadvantage is that the clips, which must support the weight of the cladding and sub-framing system, are of substantial size and still penetrate the layer of exterior insulation. Thus, the clips still create a substantial thermal bridge. This has the further disadvantage of not complying with more stringent building codes that require continuous exterior insulation. Another disadvantage of the clips is they add another layer that increases the overall thickness of the wall. This may not be permissible where the wall already abuts the property line or reaches the setoff depth. Further, this may not be aesthetically pleasing, as windows and doors appear sunken-in. Another disadvantage is that the use of clips substantially increases the complexity of the system, thereby increasing manufacturing costs and installation costs.

Still others have attempted to solve this problem using hybrid systems. However, such hybrid systems still have many disadvantages.

One disadvantage is that such hybrid systems are not compatible with conventional sheathing boards. This makes such hybrid systems unavailable for existing structures that already have sheathing installed. Still yet another disadvantage is that such hybrid systems use vertical elements that are secured to the exterior of the hybrid boards. This requires that each vertical element must individually align with each stud in the wall, which is a laborious process that is complicated by the fact that the studs may not be true and the spacing of the studs, even within the same building, often varies.

Thus, the spacing of the vertical elements is outside the control of the designer of the sub-framing system who must ensure that sufficient vertical elements are used to support the weight of the cladding. Another disadvantage is that all sides of the vertical elements must be sealed using sealing tape because the hybrid boards have a water resistant barrier that is penetrated by the fasteners during installation. This greatly increases installation costs and time. Still another disadvantage is that such hybrid systems use galvanized metal for the vertical elements, which has all the disadvantages discussed above.

As such, there is a need for a framing system that has a greater resistance to corrosion, is simple and efficient to install, and adaptable to many different buildings and structural features. The system needs to be able to enhance the aesthetic appearance, especially of windows. Still further, there is a need for a framing system that has these advantages and is capable of being manufactured cost effectively and from low cost materials. Further, such a framing system should provide for continuous insulation.

SUMMARY

The present invention provides a sub-framing wall system for supporting exterior cladding attachable to an exterior side of a wall. The system comprises horizontal elements positioned horizontally on an exterior side of a wall. Each of the horizontal elements comprises a board flange having an interior side and an opposite exterior side. An upper ridge and a lower ridge forming a relief channel are provided on the interior side of the board flange. A setoff extends outward from the exterior side of the board flange proximate to the lower ridge and slopes downward from the board flange. A frame flange extends vertically downward from the setoff, parallel and offset to the board flange. The interior side of the board flange of the horizontal elements faces the wall. First fasteners extend through the board flange to fasten the horizontal elements to structural wall studs within the wall. Vertical elements are positioned vertically on the exterior side of the horizontal elements.

Each of the vertical elements comprises a hat channel and a face plate. The hat channel has an elongated planar base, a pair of side walls extending upward from the base, and a latch extending inward from each side wall. A cap seat extends above each latch and outward of each side wall. A first and second flange extend outward of each cap seat.

Conveniently, face plates are securable to hat channels without the use of tools. The face plates have an elongated, planar body having an interior and an opposite exterior surface. A pair of opposing side legs extends downward from the interior surface of the body. A strike ridge extends outward from each side leg for connection to the hat channel.

Second fasteners extend through the base of the vertical elements and into the frame flange of the horizontal elements to fasten the vertical elements to the horizontal elements. An exterior cladding element is attachable to the vertical elements by a fastener or adhesive. Each of the horizontal elements is fastened to two or more structural wall studs and can be spaced apart from each other independent of the spacing between the structural wall studs.

In another embodiment, the relief channel is receivable of a self-sealing tape. The tape may have a thickness greater than the depth of the relief cavity. In another embodiment, the tape is a self-sealing butyl tape.

In another embodiment, the vertical elements are spaced apart from each other independent of the spacing between the structural wall studs. Each of the vertical elements may be fastened to two or more horizontal elements. In another embodiment, each of the horizontal elements is attached to each of the structural wall studs by a single fastener.

In another embodiment, the horizontal elements and the vertical elements are fabricated from extruded aluminum. In one embodiment, the material is an 11 gauge 6000 series extruded aluminum.

In another embodiment, an insulation layer is located between the wall and the horizontal elements, and the first fasteners extend through the insulation layer. In another embodiment, a sheathing layer is located between the insulation layer and the vertical studs, and the first fasteners penetrate the sheathing layer. In another embodiment, a water resistant barrier layer is located between the wall and the horizontal elements, the first fasteners extending through the water resistant layer.

In another preferred embodiment, a sub-framing wall system for supporting exterior cladding attachable to an exterior side of a wall is provided. The system comprises a plurality of horizontal elements positioned horizontally on an exterior side of a wall. The horizontal elements are spaced apart from each other independent of the spacing between structural wall studs within the wall. First fasteners extend through the horizontal elements to fasten the horizontal elements to the structural wall stud. A plurality of vertical elements is provided. The vertical elements are spaced apart from each other independent of the spacing between the structural wall studs. Second fasteners extend through the vertical elements and into the horizontal elements to fasten the vertical elements to the horizontal elements. An exterior cladding element is attachable to the vertical elements.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Figure 1:
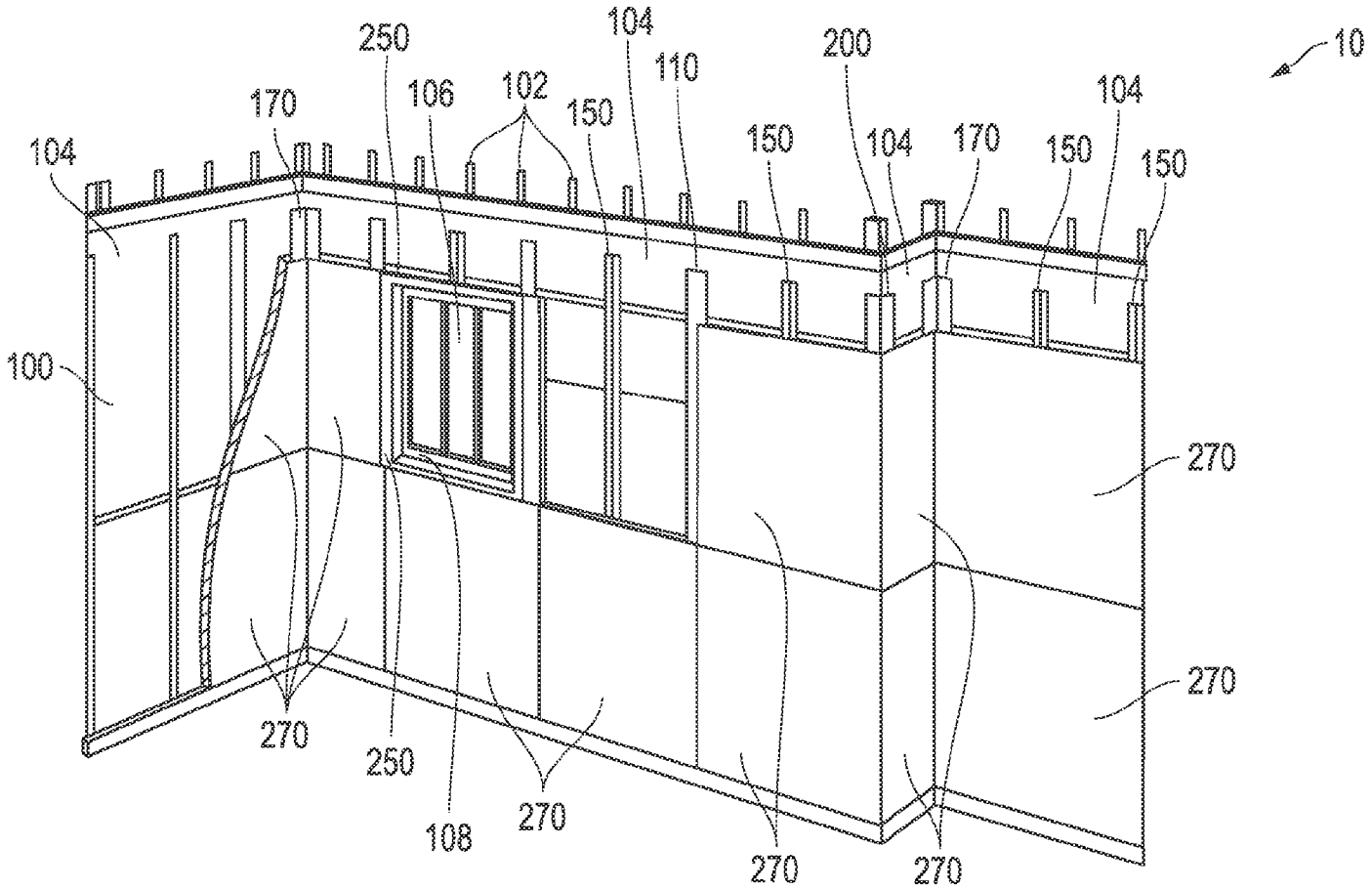
FIG. 1 is an isometric, partial-cutaway view of a structural wall embodying the sub-framing system in accordance with an embodiment of the present invention.

Referring to FIG. 1, sub-framing system 10 is exemplified as installed on a wall 100 of a structure comprising studs 102 (not all shown are labeled) that are covered by sheathing 104 or boarding, dry wall or plaster board, etc. Sub-framing system 10 comprises hat channels 110, face plates 130 (not shown), Z-channels 150, inside corner trims 170, outside corner trims 200, and window trims 220 (not shown) that are assembled into trim-frame assembly 250. The parts of sub-framing system 10 may be made of 11 gauge 6000 series extruded aluminum. Each hat channel 110 is arranged vertically and secured to wall 100 with fasteners such as self-tapping screws. Face plates 130 (FIG. 3) are snapped into each hat channel 110. Z-channels 150 are also arranged vertically and secured to wall 100 by fasteners such as self-tapping screws.

Inside corner trims 170 are arranged vertically and secured to the inside corners of wall 100 with fasteners such as self-tapping screws. Outside corner trim 200 is arranged vertically and similarly secured to the outside corner of wall 100. Trim-frame assembly 250 is placed around frame 108 of window 106. Panels of cladding 270 are then secured to hat channels 110, Z-channels 150, inside corner trims 170, and outside corner trim 200 using fasteners, which may be rivets. Sub-framing system 10 may be used on the exterior of a building (i.e., as a rain screen) or the interior of a building.

Figure 2:
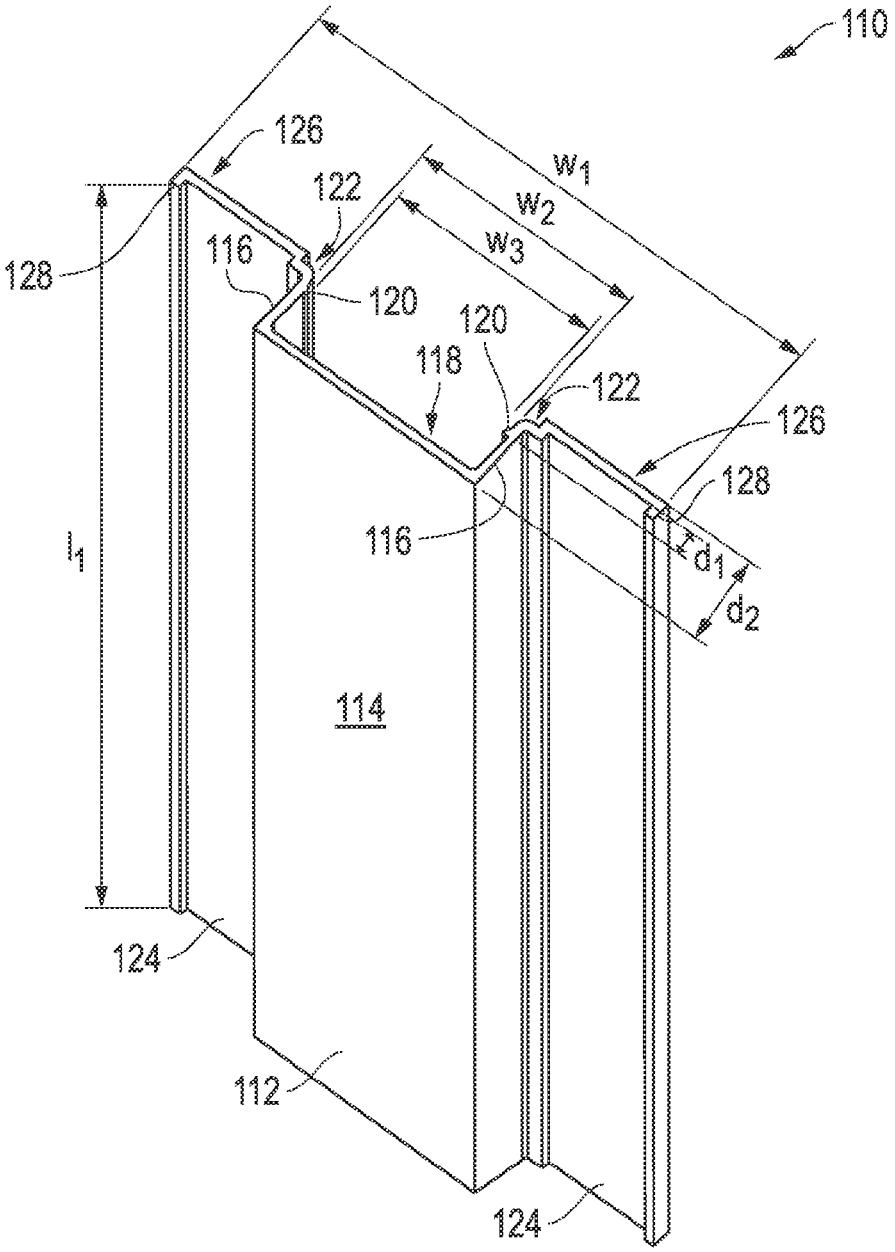
FIG. 2 is an isometric view of a hat channel component of the system illustrated in accordance with an embodiment of the invention.

Referring to FIG. 2, an isometric view of hat channel 110 is provided in accordance with an embodiment of the invention. Hat channel 110 comprises an elongated, planar base 112 and a pair of side walls 116 perpendicularly coupled to the ends of base 112. Base 112 has a width of $w_2$. Base 112 has a wall-facing surface 114 for securing hat channel 110 to a wall using a fastener. Side walls 116 are parallel to one another and perpendicular to base 112. A U-shaped channel 118 is defined by the base 112 and side walls 116. Latches 120 are formed on the interior-sides of side walls 116 and protrude into U-shaped channel 118. Latches 120 extend longitudinally the length of U-shaped channel 118 and are offset from the end of the side walls 116 by a depth of $d_1$.

A cap seat 122 extends above and outward of each latch 120. Cap seats 122 provide a seat for face plate 130 (FIG. 3) to rest on engagement with hat channel 110. Flanges 124 extend outward from cap seats 122. Flanges 124 have cladding-facing surfaces 126 opposite to the wall-facing surface 114 for securing one or more panels of cladding to hat channel 110. Flanges 124 are offset from the ends of the side walls 116 by cap seats 122. Curls 128 may be formed at the distal ends of flanges 124 to add strength and safety in handling. Hat channel 110 has an overall width of $w_1$, a depth of $d_2$, and a length of $l_1$. By way of example, and not as a limitation, $w_1$ may be approximately 5.4 inches and $d_2$ may be approximately 0.88 inches for convenient commercial use. As a further example only, hat channel 110 may be manufactured to have a length $l_1$ of approximately 20 feet that may be cut to any desired length during installation.

Figure 3:
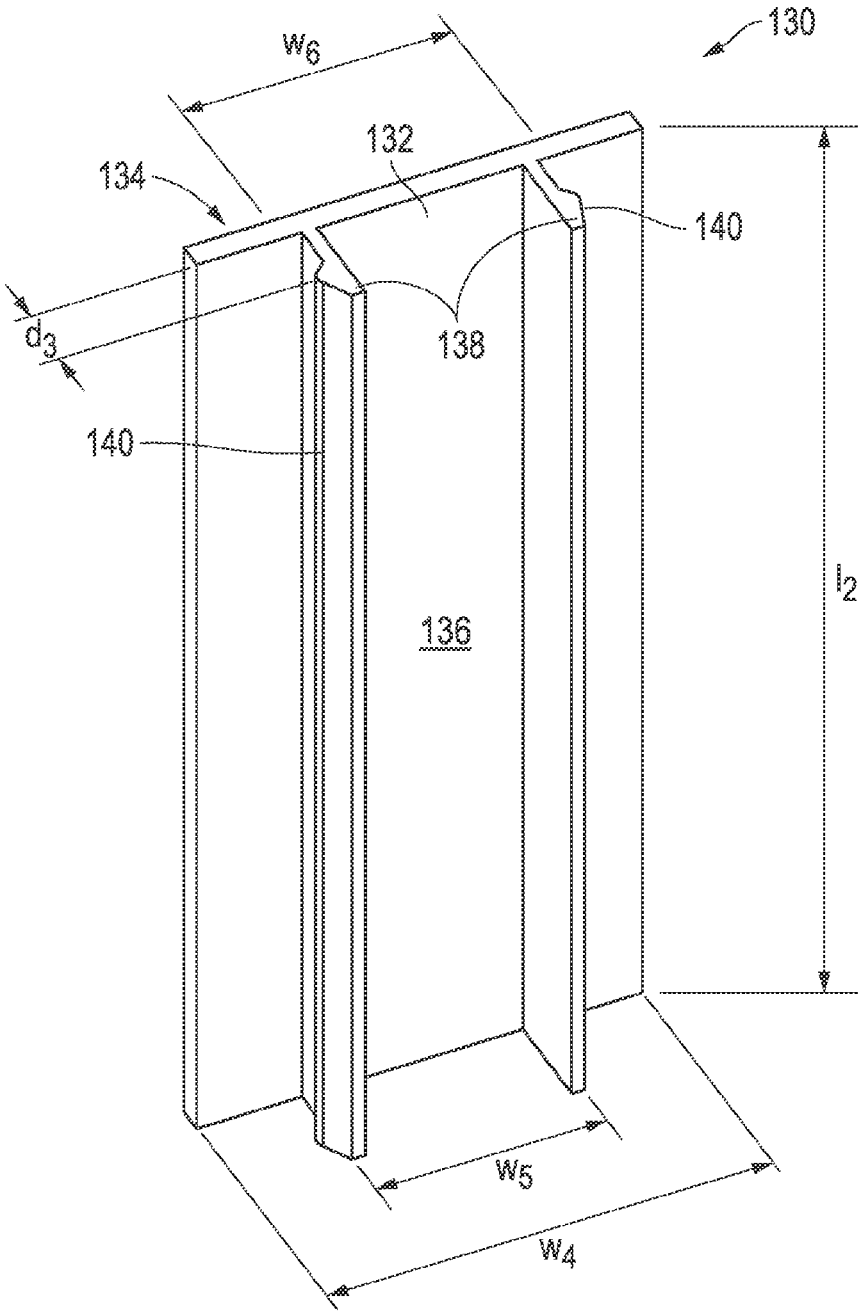
FIG. 3 is an isometric view of a face plate of the system illustrated in accordance with an embodiment of the invention.

Referring to FIG. 3, an isometric view of face plate 130 is provided in accordance with an embodiment of the invention. Face plate 130 comprises an elongated, planar body 132 having a generally rectangular cross section. Body 132 has an exterior surface 134 and an opposite, interior surface 136. Body 132 has a width of $w_4$. A pair of parallel, opposing side legs 138 extends outward from body 132, and longitudinally along interior surface 136. Side legs 138 are spaced apart by width $w_5$. Strike ridges 140 extend outward of each side leg 138. Side legs 138 and base 112 form a channel. Width $w_6$ spans between the outermost points of strike ridges 140. Strike ridges 140 are offset from the body 132 by a depth of $d_3$. Strike ridges 140 engage latches 120 of a hat channel 110 (not shown), which allow face plate 130 to be snapped into hat channel 110. Strike ridges 140 have sloped surfaces for complementary sliding engagement with sloped surfaces on latches 120 to facilitate snapped engagement. Relief radiuses 133 (FIG. 4A) are located on each outside corner formed between each side leg 138 and body 132. Relief radiuses 133 are advantageous because they allow side legs 138 to deform inwards when face plate 130 is snapped into hat channel 110. By way of example, and not as a limitation, $w_4$ may be approximately 2.7 inches, $w_5$ may be approximately 2.3 inches, and $d_3$ may be approximately 0.23 inches. As a further example only, face plate 130 may be manufactured to have a length $l_2$ of approximately 20 feet that may be cut to any desired length during installation.

Figure 4:
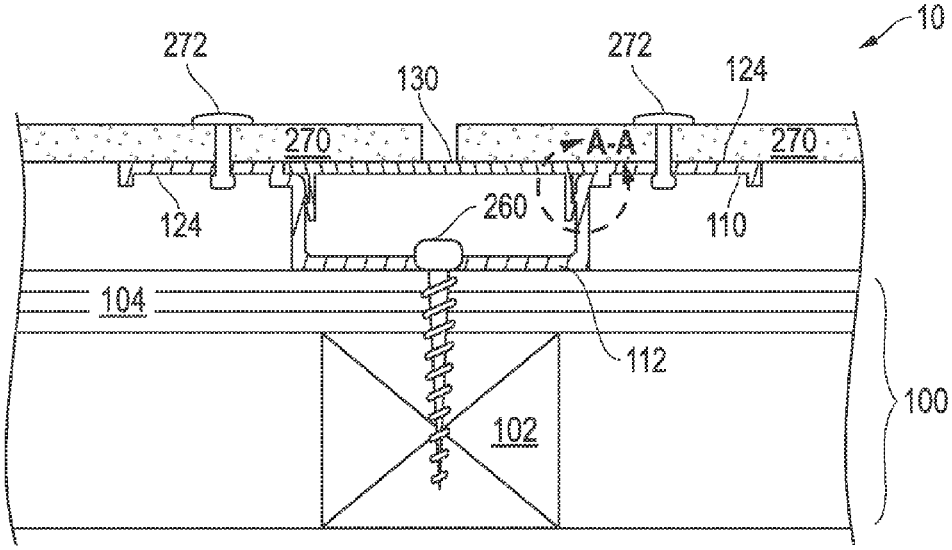
FIG. 4 is a cross-sectional, plan view of the hat channel and the face plate embodiments of FIGS. 3 and 4 exemplified as installed in a structural wall.
Figure 4A:
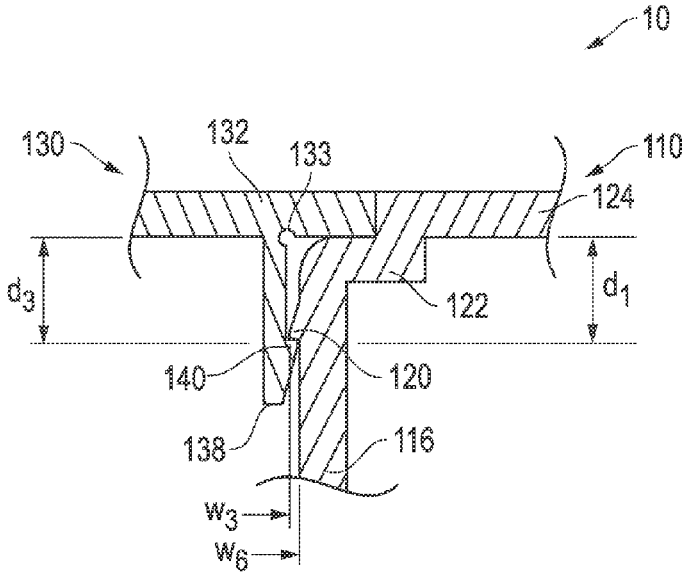
FIG. 4A is a close-up view of the hat channel and the face plate of FIGS. 3 and 4 taken along view line A-A.

Referring to FIGS. 4 and 4A, hat channel 110 and face plate 130 are exemplified securing panels of cladding 270 to a structural wall 100. Wall 100 comprises stud 102 to which sheathing 104 is secured. Optionally, a water resistant barrier (not shown) may be applied to the exterior surface of sheathing 104. Hat channel 110 is aligned vertically such that the wall-facing surface 114 (not shown) faces stud 102 and is fastened using a fastener 260 that penetrates base 112, which may be, for example, a self-tapping screw.

In one preferred embodiment, face plate 130 is "snapped" into hat channel 110, thereby presenting an aesthetically pleasing smooth surface beneath the joints of adjacent paneling sections 270, and protecting fastener 260 from the external environment such as rain, sun, and thermal exposure. When face plate 130 is snapped in, strike ridges 140 of face plate 130 engage latches 120 of hat channel 110 to secure face plate 130 to hat channel 110. Sloped surfaces on strike ridges 140 and latches 120 facilitate engagement. Upon urging face plate 130 towards hat channel 110, side legs 138 bend elastically in an inward direction to permit passage of strike ridges 140 past latches 120 until they engage, and side legs 138 return to their normal position, or to a position of minimal bending to secure face plate 130 to hat channel 110. Relief radiuses 133 are advantageously provided to permit side legs 138 to elastically bend without cracking or breaking. It will also be recognized that this may be accomplished with a combination of outwardly elastic bending of side walls 116.

Panels of cladding 270 are then secured to the cladding-facing surfaces 126 (see FIG. 2) of flanges 124 using fasteners 272 such as rivets. Epoxies or other adhesives may also be used. As described, hat channel 110 and face plate 130 are particularly advantageous for securing joints where two panels of cladding come together. Advantageously to these installations, hat channel 110 may also secure a single panel of cladding (not shown).

In an alternate embodiment, hat channel 110 may be installed in a "reverse" configuration (not shown). That is, flanges 124 may be used to secured hat channel 110 to a wall; while, panels of cladding 270 are secured to base 112. This "reversibility" is particularly advantageous when hat channel 110 is securing a single panel of cladding.

Figure 5:
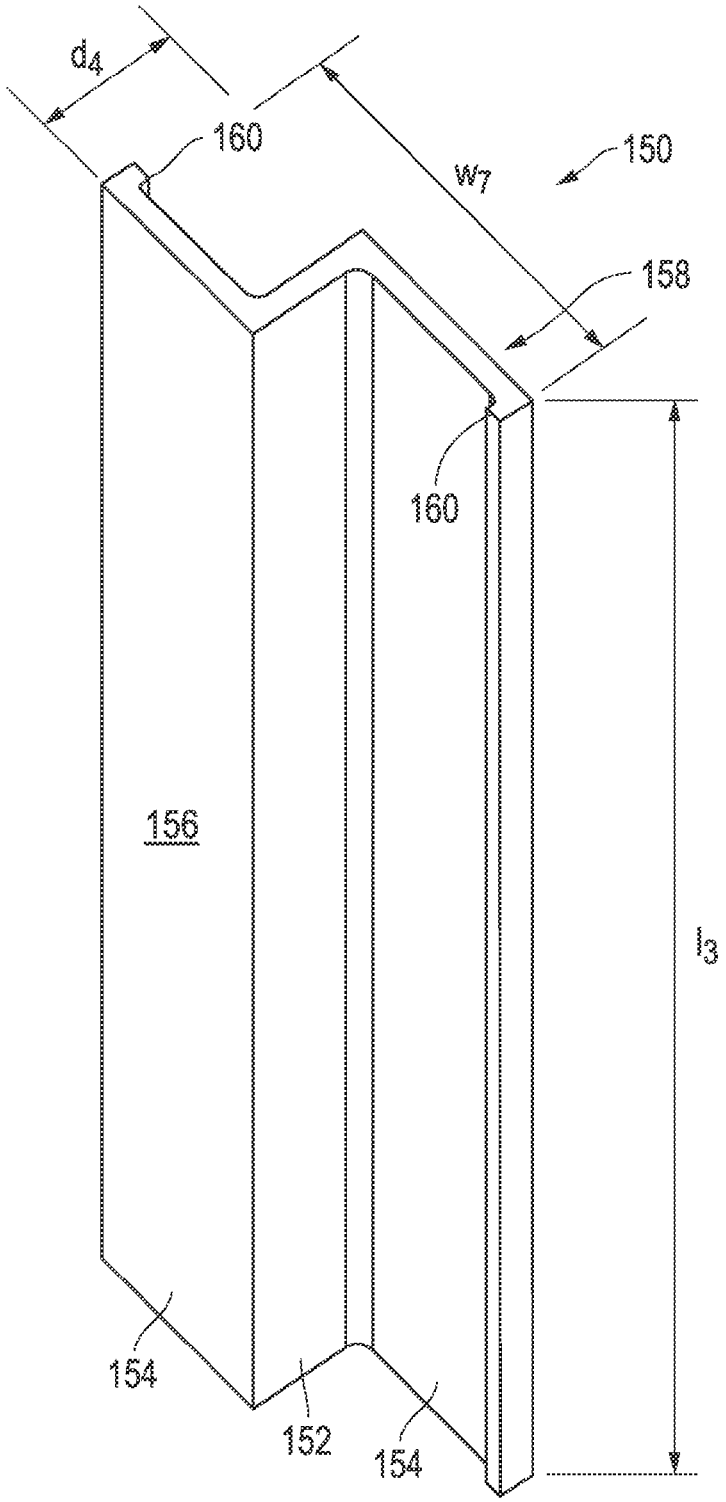
FIG. 5 is an isometric view of a Z-channel illustrated in accordance with an embodiment of the invention.

Referring to FIG. 5, an isometric view of Z-channel 150 is provided. Z-channel 150 comprises a central wall 152 having a pair of flanges 154 extending perpendicularly outward from central wall 152. The pair of flanges 154 is parallel and offset from one another by a depth of $d_4$. Curls 160 are formed at the ends of each flange 154 to add strength and for safety in handling. Z-channel 150 has a cladding-facing surface 158 to which a panel of cladding may be secured and a wall-facing surface 156 used to secure Z-channel 150 to a structural wall. By way of example, and not as a limitation, $w_7$ may be approximately 2.9 inches, and $d_4$ may be approximately 0.88 inches for convenient commercial use. As a further example only, Z-channel 150 may be manufactured to have a length $l_3$ of approximately 20 feet that may be cut to any desired length during installation.

Figure 6:
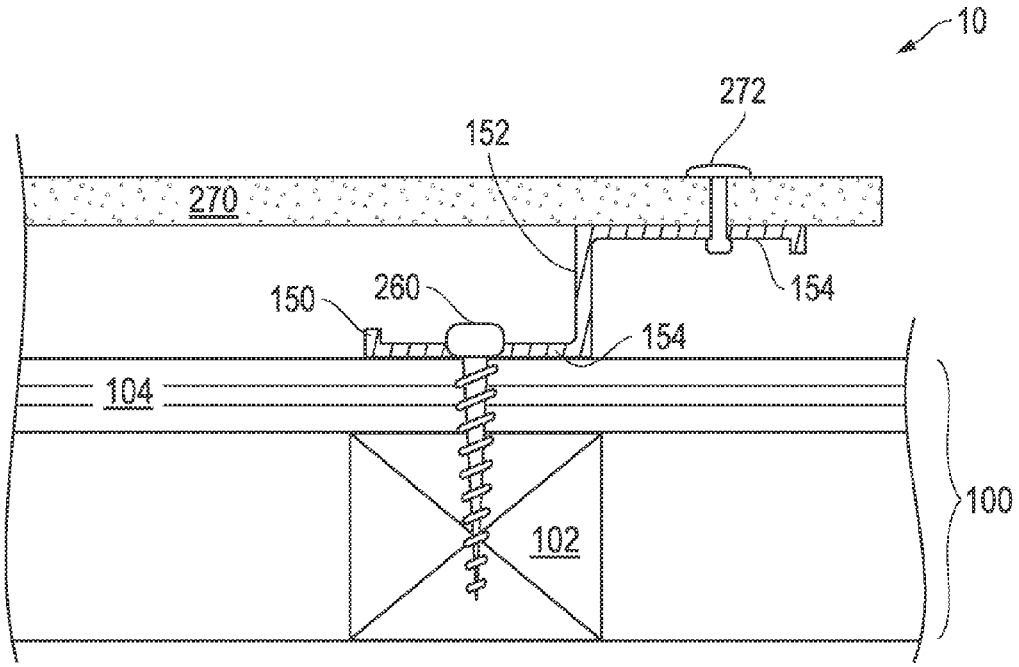
FIG. 6 is a cross-sectional, plan view of the Z-channel of FIG. 5 exemplified as installed in a structural wall.

Referring to FIG. 6, Z-channel 150 is exemplified securing a panel of cladding 270 to a structural wall 100. Wall 100 comprises stud 102 to which sheathing 104 is secured. Optionally, a water resistant barrier (not shown) may be applied to the exterior surface of sheathing 104. Z-channel 150 is aligned vertically such that the wall-facing surface 156 (not shown) faces stud 102 and is then secured using fastener 260, which may be a self-tapping screw. A panel of cladding 270 is then secured to the cladding-facing surface 158 (not shown) using fasteners 272, which may be rivets. Z-channels are particularly advantageous for securing an end or central portion of a single panel of cladding 270 (see also FIG. 1).

Figure 7:
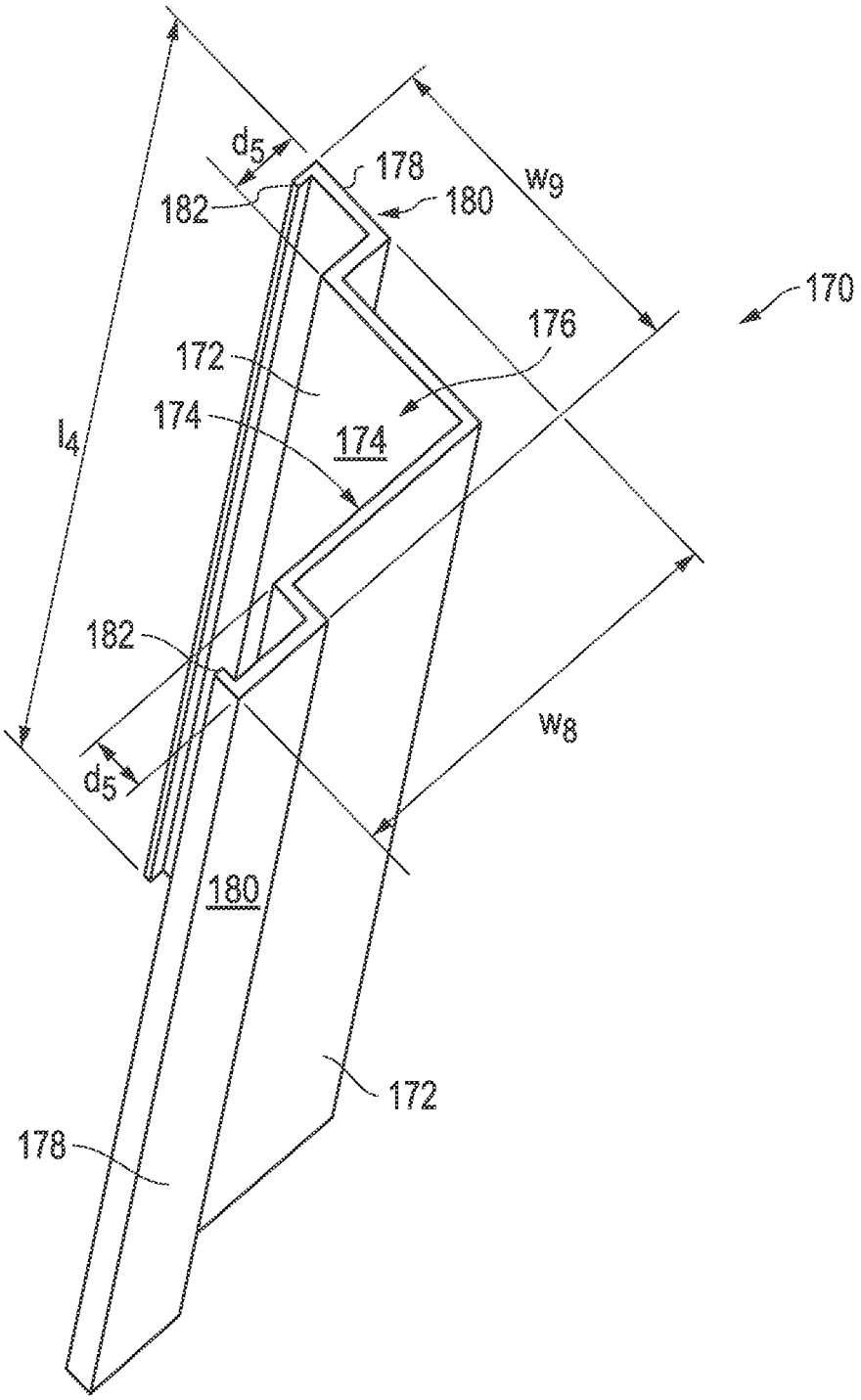
FIG. 7 is an isometric view of an inside corner trim component of the system illustrated in accordance with an embodiment of the invention.

Referring to FIG. 7, an isometric view of inside corner trim 170 is provided in accordance with the present invention. Inside corner trim 170 comprises a pair of elongated walls 172 that are perpendicular to one another and form L-channel 176. Each wall 172 has cladding-facing surface 174 to which a panel of cladding may be secured. Flanges 178 are coupled to the ends of walls 172. Each flange 178 is parallel to and offset outwards and away from the L-shaped channel 176 by an amount $d_5$ from its respective wall 172. Curls 182 are formed at the ends of each flange 178. Each flange 178 has a wall-facing surface 180 for securing inside corner trim 170 to a structural wall. Inside corner trim 170 has a width of $w_8$ and $w_9$. Inside corner trim 170 may be symmetrical, but need not be. Inside corner trim 170 has a length of $l_4$. By way of example, and not as a limitation, $w_8$ and $w_9$ may be approximately 4.8 inches, and $d_5$ may be approximately 0.88 inches for convenient commercial use. As a further example only, inside corner trim 170 may be manufactured to have a length $l_4$ of approximately 20 feet that may be cut to any desired length during installation.

Figure 8:
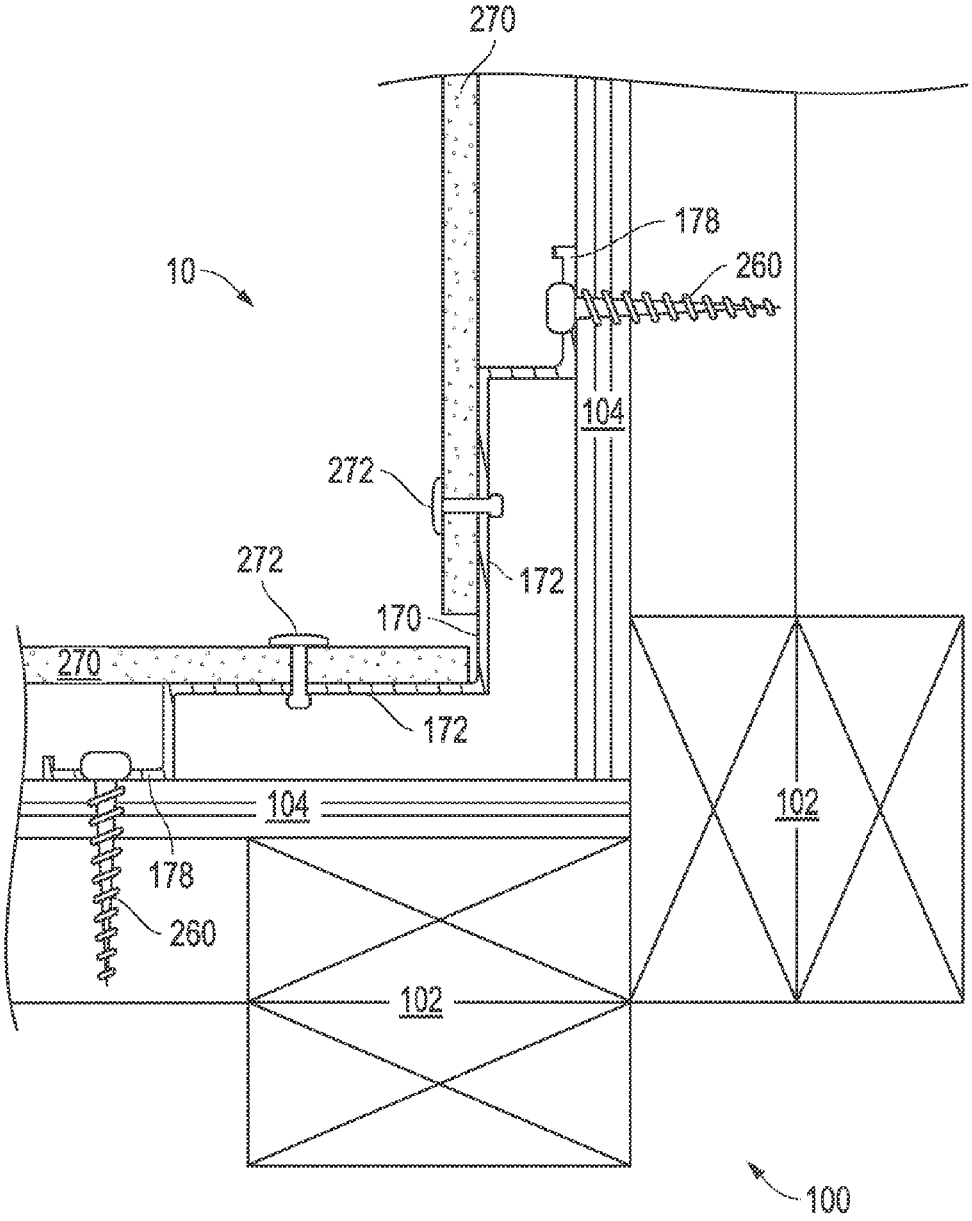
FIG. 8 is a cross-sectional, plan view of the inside corner trim of FIG. 7 exemplified as installed in a structural wall.

Referring to FIG. 8, inside corner trim 170 is exemplified securing panels of cladding 270 to a structural wall 100 that forms a corner. Wall 100 comprises studs 102 to which sheathing 104 is secured. Optionally, a water resistant barrier (not shown) may be applied to the exterior surface of sheathing 104. Inside corner trim 170 is aligned vertically such that wall-facing surfaces 180 (not shown) of flanges 178 urge against wall 100. Inside corner trim 170 is secured using fasteners 260, which may be self-tapping screws. Panels of cladding 270 are then secured to cladding-facing surfaces 174 (not shown) of walls 172 using fasteners 272, which may be rivets.

Figure 9:
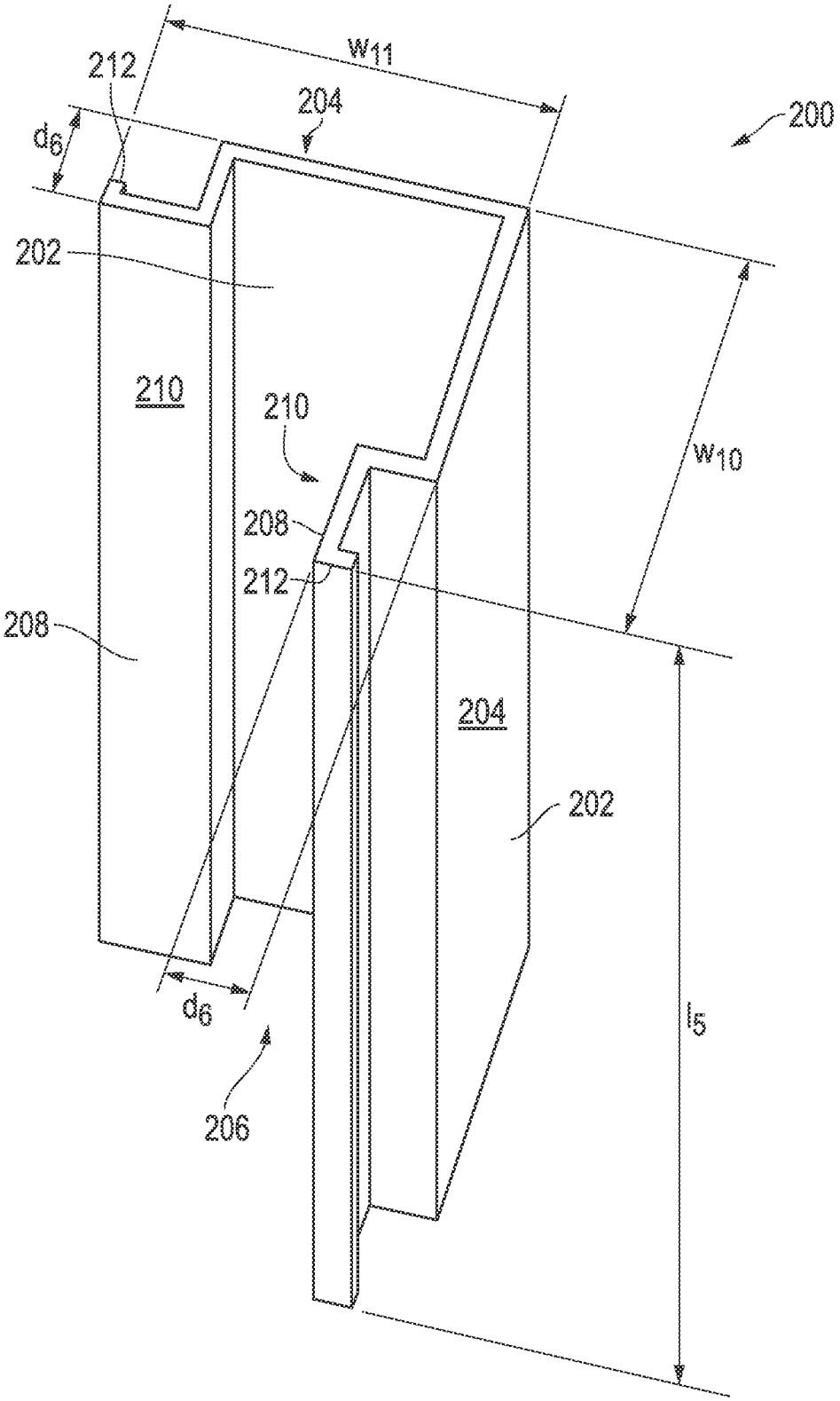
FIG. 9 is an isometric view of an outside corner trim component of the system illustrated in accordance with an embodiment of the invention.

Referring to FIG. 9, an isometric view of outside corner trim 200 is provided in accordance with the present invention. Outside corner trim 200 comprises a pair of elongated walls 202 that are perpendicular to one another and form L-channel 206. Each wall 202 has cladding-facing surface 204 to which a panel of cladding may be secured. Flanges 208 are coupled to the ends of wall 202. Each flange 208 is parallel to and offset inwards towards L-channel 206 by an amount $d_6$ from its respective wall 202. Curls 212 are formed at the ends of each flange 208. Each flange 208 has a wall-facing surface 210 for securing outside corner trim 200 to a structural wall. Outside corner trim 200 has total widths of $w_{10}$ and $w_{11}$. Outside corner trim 200 may be symmetrical, but need not be. Outside corner trim 200 has a length of $l_5$. By way of example, and not as a limitation, $w_{10}$ and $w_{11}$ may be approximately 4.8 inches, and $d_6$ may be approximately 0.88 inches. As a further example only, outside corner trim 200 may be manufactured to have a length $l_5$ of approximately 20 feet that may be cut to any desired length during installation.

Figure 10:
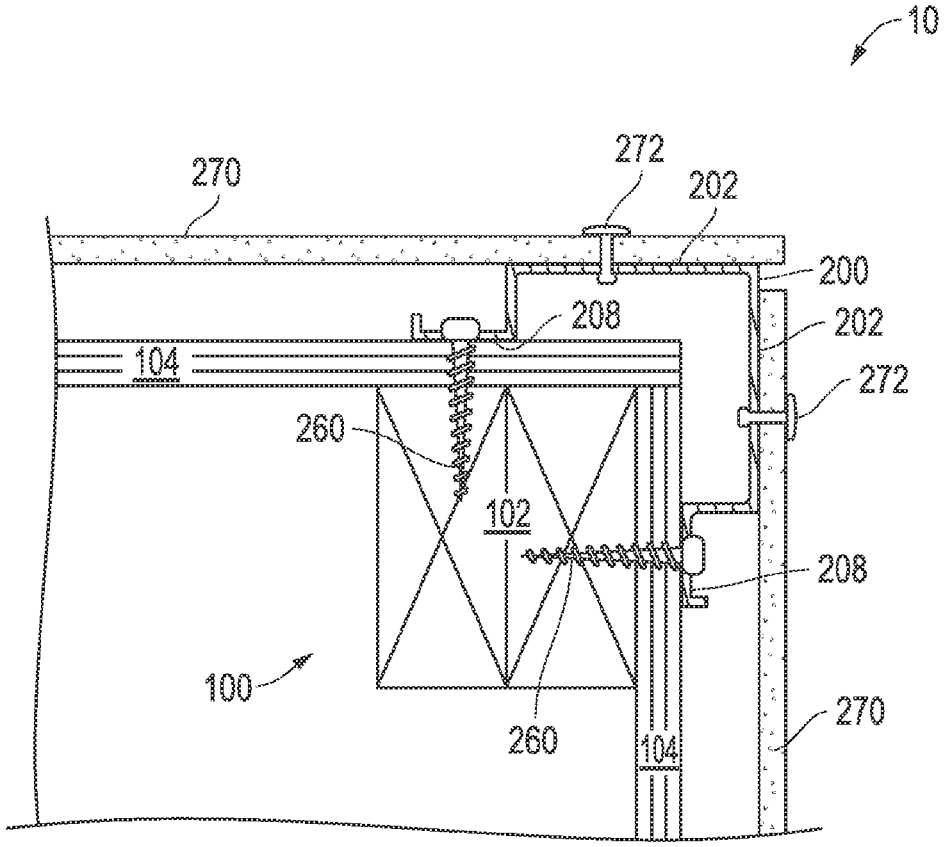
FIG. 10 is a cross-sectional, plan view of the outside corner trim of FIG. 9 exemplified as installed in a structural wall.

Referring to FIG. 10, outside corner trim 200 is exemplified securing panels of cladding 270 to a structural wall 100 that forms a corner. Wall 100 comprises stud 102 to which sheathing 104 (or dry wall, plaster board or boarding) is secured. Optionally, a water resistant barrier (not shown) may be applied to the exterior surface of sheathing 104. Outside corner trim 200 is aligned vertically such that wall-facing surfaces 210 (not shown) of flanges 208 urge against wall 100 and align with stud 102. Outside corner trim 200 is secured using fasteners 260, which may be self-tapping screws. Panels of cladding 270 are then secured to cladding-facing surfaces 204 (not shown) of walls 202 using fasteners 272, which may be rivets.

Figure 11:
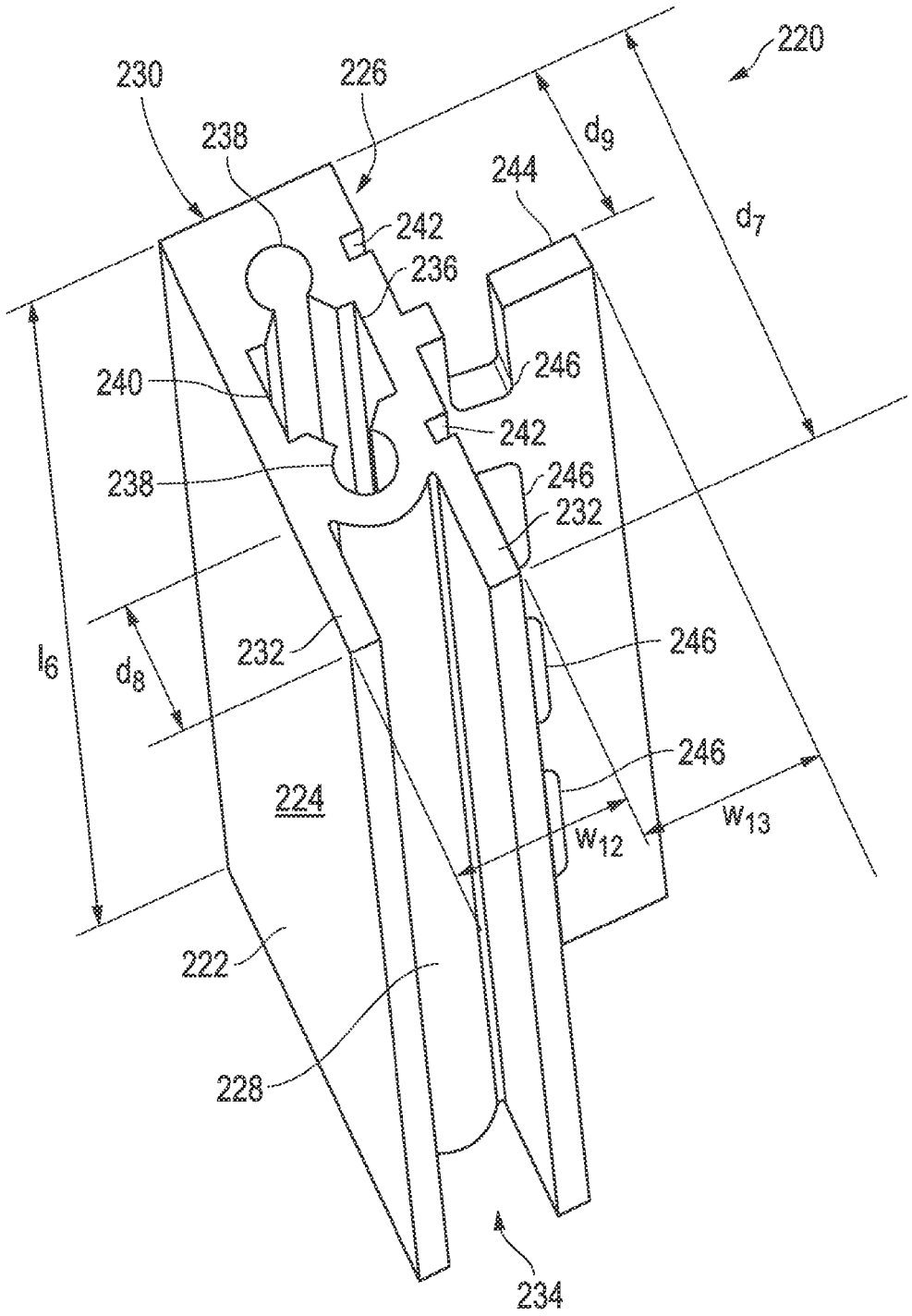
FIG. 11 is an isometric view of a window trim component of the system illustrated in accordance with an embodiment of the invention.

Referring to FIG. 11, an isometric view of window trim 220 is provided. Window trim 220 comprises an elongated body 222 that generally has a rectangular cross section and has a width of $w_{12}$ and a depth of $d_7$. By way of example, and not as a limitation, $w_{12}$ may be approximately 0.5 inches, and $d_7$ may be approximately 1.2 inches. Body 222 has frame-facing surface 224 and an opposite cladding-facing surface 226. Body 222 also has wall-facing surface 228 perpendicular to frame-facing surface 224 and cladding-facing surface 226. Body 222 also has exterior-facing surface 230 opposite wall-facing surface 228. A pair of legs 232 is formed along the wall-facing surface 228 that define U-channel 234. Wall-facing surface 228 between legs 232 may be rounded.

U-channel 234 has a depth of $d_8$, which, by way of example, and not as a limitation, may be approximately 0.27 inches for convenient commercial use. U-channel 234 conserves material and also enables easier trimming to make fine adjustments to the depth of window trim 220.

Central cavity 236 is formed longitudinally through the length of body 222 and is parallel to U-channel 234. Central cavity 236 comprises a pair of cylindrical, fastener bosses 238, or more particularly screw bosses. Fastener bosses 238 provide an opening for fasteners, which may be self-tapping fasteners, which are used to assemble window trims 130 into a trim-frame assembly 250 (not shown) as explained below. In addition to fastener bosses 238, central cavity 236 has a rectangular channel 240. Channel 240 reduces weight and the amount of material required. A pair of longitudinal notches 242 is formed along cladding-facing surface 226 of body 222 and run parallel to each fastener boss 238. Notches 242 provide a visual aid for identifying the location of fastener bosses 238 and also reduce material requirements.

Flange 244 protrudes outward from cladding-facing surface 226 of body 222 by an amount of $w_{13}$. By way of example, and not as a limitation, $w_{13}$ may be approximately 0.5 inches. Flange 244 is parallel to, and offset from, exterior-facing surface 230 by a depth of $d_9$, which, by way of example, and not as a limitation, may be approximately 0.69 inches. Perforations 246 are formed along the length of flange 244, which permit air circulation when installed and also reduce weight and material requirements. Window trim 220 has a length of $l_6$.

Figure 12A:
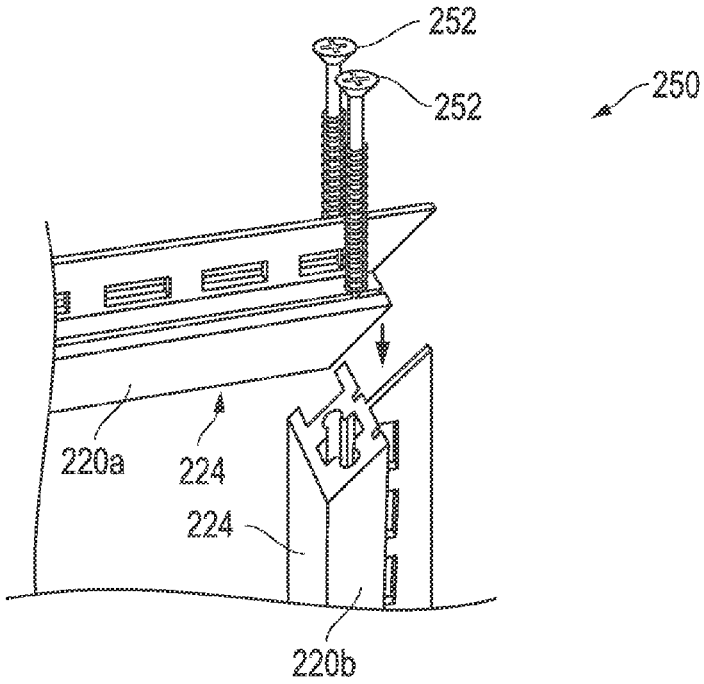
FIGS. 12A and 12B are isometric views of window trims being assembled into a trim-frame assembly.
Figure 12B:
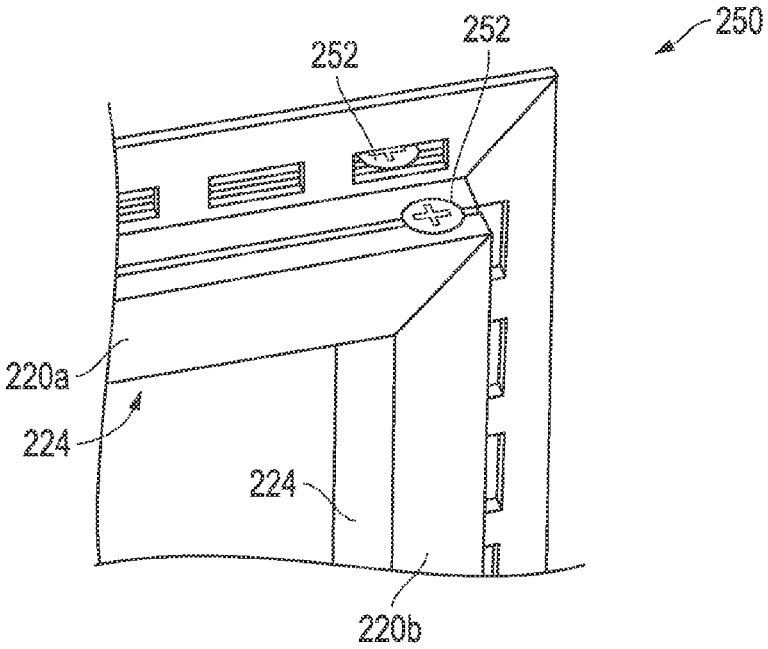

Referring to FIGS. 12A and 12B, a pair of window trims 220*a* and 220*b* is exemplified being joined together to create trim-frame assembly 250. First, window trims 220*a* and 220*b* are cut to the desired length. Then the ends of each window trim are cut at a 45 degree angle. The length of frame-facing surface 224 of each window trim corresponds to the exterior dimensions of a window or object that is being framed. Then, window trims 220*a* and 220*b* are brought together and fastened using fasteners 252, which may be self-tapping screws.

Figure 13:
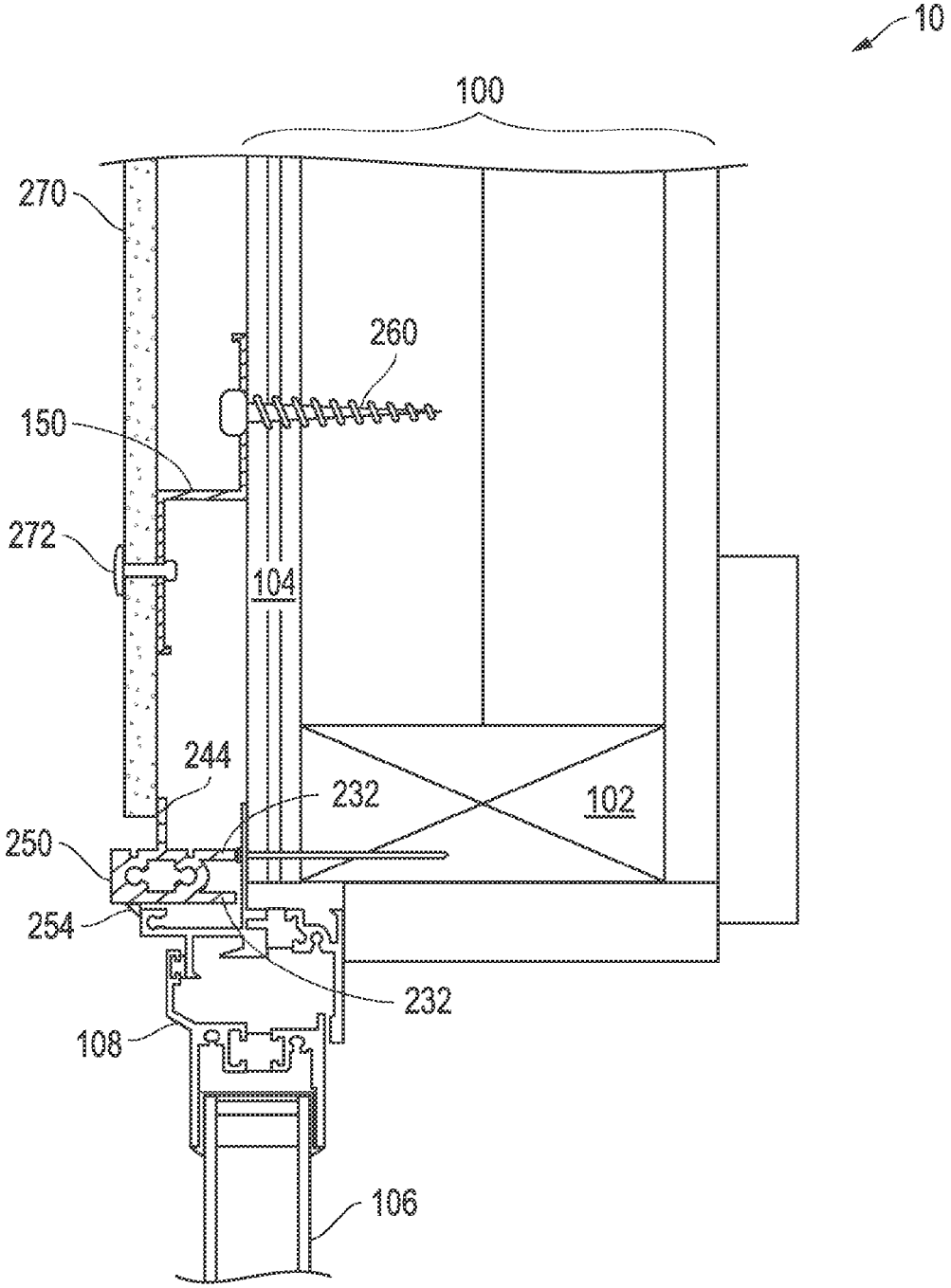
FIG. 13 is a cross-sectional, plan view of the trim-frame exemplified as installed in a structural wall.

Referring to FIG. 13, trim-frame assembly 250 is exemplified framing outside window 106, which is a nail-on window as is typically used in residential structures. Window frame 108 of window 106 is nailed to stud 102 of structural wall 100. Window trims 220 (FIGS. 11 and 12) are assembled into a trim assembly 250 as described above. Trim-frame assembly 250 is then positioned around window frame 108. Trim-frame assembly 250 may have the same finish as window frame 108, which is advantageous because it provides an effect that trim-frame assembly 250 is part of window frame 108 and is thus aesthetically pleasing. Legs 232 of trim-frame assembly 250 may be trimmed to adjust the depth of trim assembly 250. The depth of trim-frame assembly 250 may be adjusted such that the exterior surface of trim-frame assembly 250 is flush with the exterior face of cladding panels 270, which is advantageous because it makes the window frame appear to be flush with cladding and is thus aesthetically pleasing. After adjusting the depth, panels of cladding 270 are installed. The edge of panel 270 urges against flange 244 of trim-frame assembly 250, thereby securing trim-frame assembly 250 to wall 100. No fasteners are required to secure trim-frame assembly 250 in place. Optionally, trim-frame assembly 250 may be caulked to window frame 108 using caulk 254.

Figure 14:
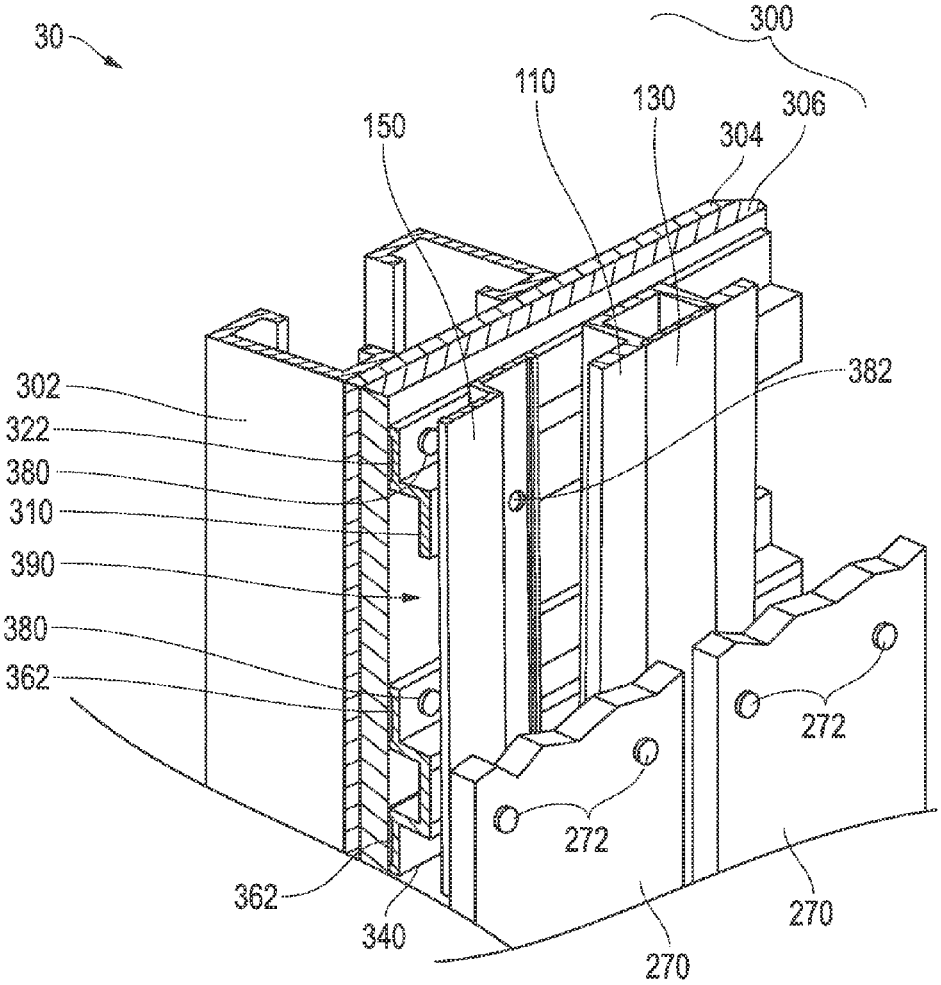
FIG. 14 is an isometric, partial-cutaway view of a structural wall embodying an improved, multi-layered framing system in accordance with a first embodiment of the present invention.

Referring to FIG. 14, a multi-layer sub-framing system 30 in accordance with another preferred embodiment of the present invention is exemplified having been installed along an exterior surface of structural wall 300. Structural wall 300 comprises a plurality of vertically-aligned metal studs 302. In alternate embodiments, the multi-layer sub-framing system 30 of the present invention may be secured to blocking, wooden studs, or sheathing. Sheathing layer 304 is secured to the exterior surface of metal studs 302. Interior insulation (not shown) is installed between metal studs 302. A water resistant barrier (WRB) layer (not shown) is applied to the exterior surface of sheathing layer 304. Exterior-insulation layer 306 is located over the exterior of sheathing layer 304, and is a semi-rigid board type insulation. Exterior-insulation layer 306 may be a rigid rock wool insulation board, such as ROXUL® COMFORTBOARD® CIS from Roxul Inc., of Milton Ontario. Such products are characteristically partially compressible, thermal and moisture resistant, having a thermal resistance of approximately R4 or greater.

Horizontal elements are positioned horizontally along the exterior surface of exterior-insulation layer 306. In a preferred embodiment, the horizontal elements comprise one or both of improved Z-channel 310 and improved hat-channel 340. In one embodiment, self-sealing tape 370, which may be a self-sealing butyl tape, may be applied in relief channels 322 and 362 of each horizontal element 310 and 340 (see FIG. 14A). A plurality of first fasteners 380, such as self-tapping threaded fasteners, extends through horizontal elements 310 and 340, exterior-insulation layer 306, and sheathing layer 304 and secures horizontal elements 310 and 340 to metal studs 302. First fasteners 380 hold horizontal elements 310 and 340 in compression against exterior-insulation layer 306, thereby indenting exterior-insulation layer 306. In one preferred embodiment, a single first fastener 380 secures each horizontal element to each metal stud. Shoulder washer 386 (FIGS. 16A and 18A) may be located around the head of each first fastener 380 to aide in thermal insulation between the fastener and the horizontal element and further seal openings formed by the fastener. Self-sealing tape 370, if present, seals around each first fastener 380. Horizontal elements 310 and 340 secure exterior-insulation layer 306 and separate fasteners or adhesives are not required to hold exterior-insulation layer 306 in place.

Vertical elements are then positioned vertically on the exterior side of horizontal elements 310 and 340. Vertical elements may include Z-channel 150 and hat channel 110. In alternate embodiments, vertical elements may also include improved Z-channels 310, improved hat channels 340, inside corner pieces 170, and outside corner pieces 200. A plurality of second fasteners 382 extends through horizontal elements 310 and 340 and vertical elements 110 and 150 and secures horizontal elements 310 and 340 to vertical elements 110 and 150. In other embodiments, a single second fastener 382 may be used to secure each horizontal element 310 and 340 to each vertical element 110 and 150. Optionally, face plate 130 may be snapped into hat channel 110 as described above.

Panels of cladding 270 are positioned along the exterior surface of vertical elements 110 and 150. A plurality of fasteners 272, which may be rivets, secures each panel of cladding 270 to vertical elements 110 and 150. In alternate embodiments in which vertical elements are not present, panels of cladding may be attached directly to horizontal elements. Ventilation cavity 390 is defined by panels of cladding 270 and the exterior surface of exterior-insulation layer 306.

Figure 14A:
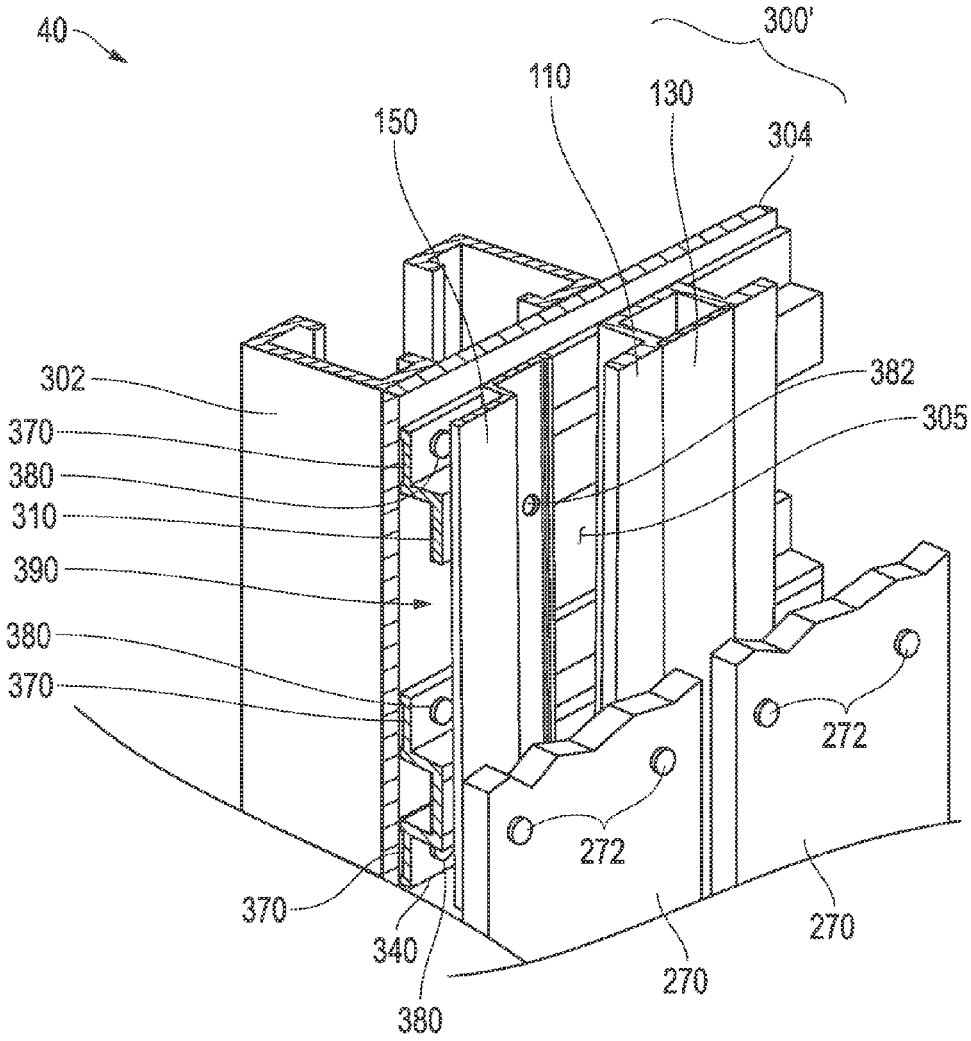
FIG. 14A is an isometric, partial-cutaway view of a structural wall embodying an improved, multi-layered framing system in accordance with a second embodiment the present invention.

Referring to FIG. 14A, a multi-layer sub-framing system 40 in accordance with an alternate embodiment of the present invention is exemplified having been installed along an exterior surface of structural wall 300'. Structural wall 300' comprises a plurality of vertically-aligned metal studs 302. In other embodiments, the multi-layer sub-framing system 30 of the present invention may be secured to blocking, wooden studs, or sheathing. Sheathing layer 304 is secured to the exterior surface of metal studs 302. Interior insulation (not shown) is installed between metal studs 302. Water resistant barrier (WRB) layer 305 is applied to the exterior surface of sheathing layer 304.

Horizontal elements are positioned horizontally along the exterior surface of WRB layer 305. In a preferred embodiment, the horizontal elements comprise one or both of improved Z-channel 310 and improved hat-channel 340. Self-sealing tape 370, which may be a self-sealing butyl tape, is applied in relief channels 322 and 362 (FIGS. 15 and 17, respectively) of each horizontal element 310 and 340. A plurality of first fasteners 380, such as self-tapping threaded fasteners, extends through horizontal elements 310 and 340, self-sealing tape 370, WRB layer 305, and sheathing layer 304 to secure horizontal elements 310 and 340 to metal studs 302. First fasteners 380 hold horizontal elements 310 and 340 in compression against WRB layer 306. In one preferred embodiment, a single first fastener 380 secures each horizontal element to each metal stud. Shoulder washers 386 (see FIGS. 16A and 18A) may be located around the head of each first fastener 380 to aide in thermal insulation between the fastener and the horizontal element and further seal openings formed by the fastener. Self-sealing tape 370 seals around each first fastener 380. Horizontal elements 310 and 340 secure exterior-insulation layer 306 and separate fasteners or adhesives are not required to hold exterior-insulation layer 306 in place.

Vertical elements are then positioned vertically on the exterior side of horizontal elements 310 and 340. Vertical elements may include Z-channel 150 and hat channel 110. In alternate embodiments, vertical elements may also include improved Z-channels 310, improved hat channels 340, inside corner pieces 170, and outside corner pieces 200. A plurality of second fasteners 382 extends through horizontal elements 310 and 340 and vertical elements 110 and 150 and secures horizontal elements 310 and 340 to vertical elements 110 and 150. In other embodiments, a single second fastener 382 may be used to secure each horizontal element 310 and 340 to each vertical element 110 and 150. Optionally, face plate 130 may be snapped into hat channel 110 as described above.

Panels of cladding 270 are positioned along the exterior surface of vertical elements 110 and 150. A plurality of fasteners 272, which may be rivets, secures each panel of cladding 270 to vertical elements 110 and 150. In alternate embodiments in which vertical elements are not present, panels of cladding may be attached directly to horizontal elements. Ventilation cavity 390 is defined by panels of cladding 270 and the exterior surface of WRB layer 305.

Figure 15:
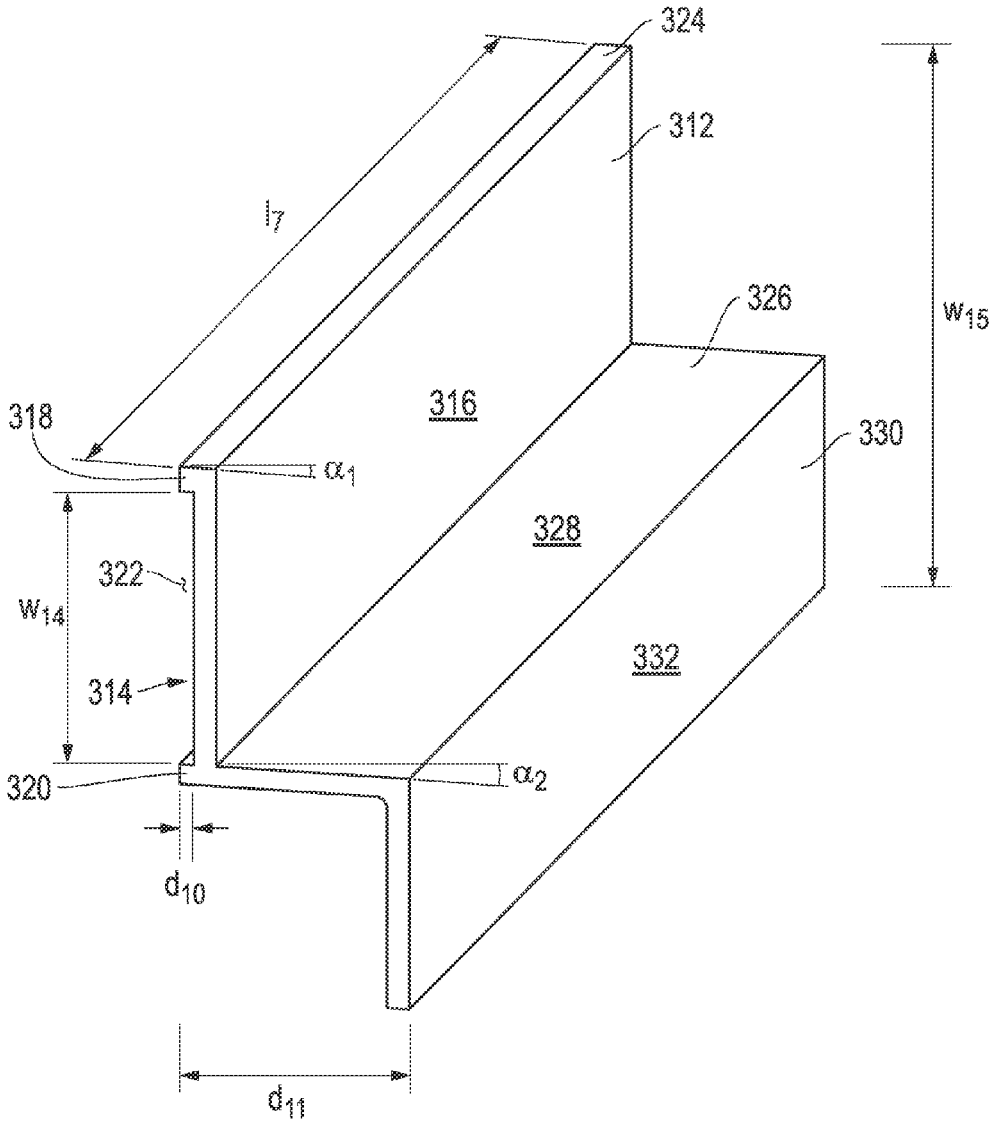
FIG. 15 is an isometric view of an improved Z-channel illustrated in accordance with the first and second embodiments of the invention.

Referring to FIG. 15, a first embodiment of a horizontal element, improved Z-channel 310, is provided in accordance with the present invention. Improved Z-channel 310 comprises board flange 312, setoff 326, and frame flange 330. Board flange 312 has interior side 314 and an opposite, exterior side 316. Upper ridge 318 and lower ridge 320 are formed along interior side 314 of board flange 312. Relief channel 322 is defined by upper ridge 318, lower ridge 320, and interior side 314.

Relief channel 322 has a depth of $d_{10}$ and a width of $w_{14}$, which are configured to receive self-sealing tape 370 (FIG. 14A). More particularly, depth $d_{10}$ may be slightly less than the thickness of self-sealing tape 370, while width $w_{14}$ is slightly greater than the width of self-sealing tape 370. This allows self-sealing tape 370 to be applied to relief channel 322, and then self-sealing tape 370 is held in compression once improved Z-channel 310 is secured (FIG. 14A). Sloped upper surface 324 of upper ridge 318 is sloped at angle $\alpha_1$ downward toward exterior side 316. In certain embodiments, $\alpha_1$ may be sloped at least about 3 degrees. By way of example, and not as a limitation, $\alpha_1$ may be about 12 degrees. Sloped upper surface 324 aids in draining water away from exterior-insulation layer 306 (FIG. 14) or WRB layer 305 (FIG. 14A).

Setoff 326 extends outward from exterior side 316 of board flange 312 proximate to lower ridge 320. Setoff 326 is sloped at angle $\alpha_2$, downward from board flange 312, thereby providing sloped surface 328, which drains water away from exterior-insulation layer 306 (FIG. 14). By way of example, and not as a limitation, $\alpha_2$ may be approximately 3 degrees. Frame flange 330 extends vertically downward from setoff 326, parallel and offset to board flange 312. Exterior side 332 of frame flange 330 is configured to provide a surface for securing vertical elements 110 and 150 (FIG. 14). Improved Z-channel 310 has overall width $w_{15}$, depth $d_{11}$, and length $l_7$, which may be configured according to the needs of a particular building design and components.

Figure 16:
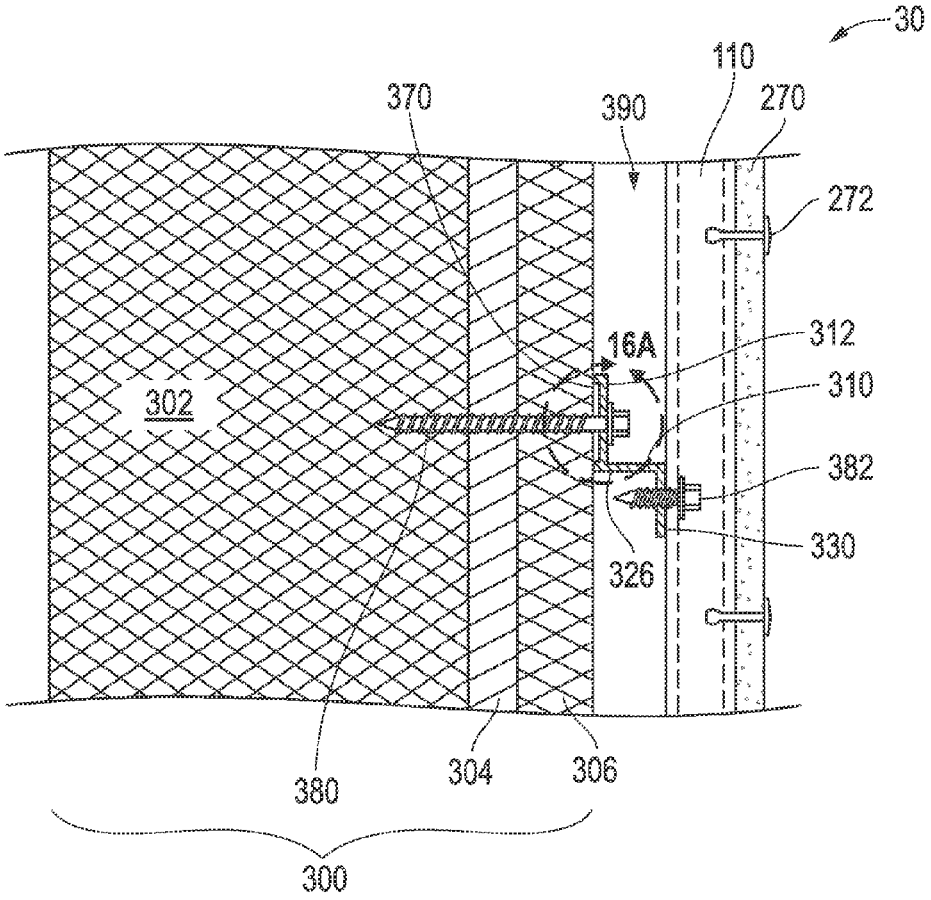
FIG. 16 is a cross-sectional, side view of the improved Z-channel of FIG. 15 exemplified as installed in a structural wall in accordance with the first embodiment of the present invention.
Figure 16A:
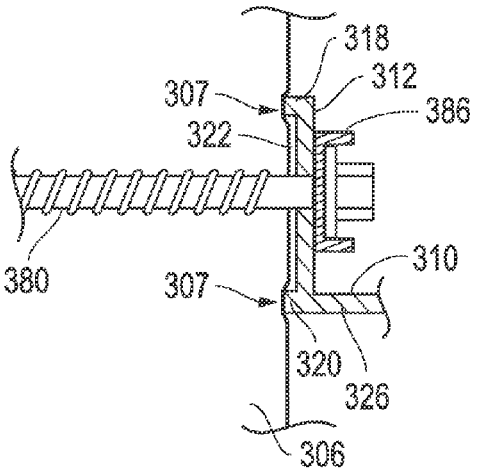
FIG. 16A is a close-up view of FIG. 16 taken along view line 16A-16A.

Referring to FIGS. 16 and 16A, improved Z-channel 310 is exemplified as a horizontal element securing vertical element 110. Wall 300 comprises vertical metal stud 302. Sheathing layer 304 is secured to the exterior of metal stud 302. Optionally, a water resistant layer (not shown) may be applied to the exterior surface of sheathing 304 (see FIG. 14A). Exterior-insulation layer 306 is positioned on the exterior side of sheathing layer 304. In alternate embodiments, exterior-insulation layer 306 may be omitted (see FIG. 14A). Improved Z-channel 310 is positioned horizontally such that its interior side 314 (FIG. 15) of board flange 312 urges against exterior-insulation layer 306. Optionally, self-sealing tape 370 may be located in relief channel 322 (FIG. 16A) of board flange 312 and may be held in compression. First fastener 380 extends through board flange 312, self-sealing tape 370, exterior-insulation layer 306, and sheathing layer 304, and secures into metal stud 302. Depressions 307 are formed in exterior-insulation layer 306 where ridges 318 and 320 compress exterior-insulation layer 306. These advantageously form a water-tight seal between ridges 318 and 320 and exterior-insulation layer 306, thereby sealing relief channel 322. As such, self-sealing tape 370 may be used to further ensure sealing but is not required. Shoulder washer 386 is located between flange 352 and the head of fastener 380, which provides additional thermal isolation and further seals the opening formed by fastener 308 in flange 352. Vertical element 110 is positioned outside frame flange 330. Second fastener 382 extends through vertical element 110 and frame flange 330 and secures vertical element 110 to improved Z-channel 310. Panel of cladding 270 is secured to vertical element 110 using fasteners 272, which may be rivets. Ventilation cavity 390 is formed between panels of cladding 270 and the exterior surface of exterior-insulation layer 306. As such, a continuous layer of exterior insulation is provided that is unpenetrated by a framing element.

Figure 17:
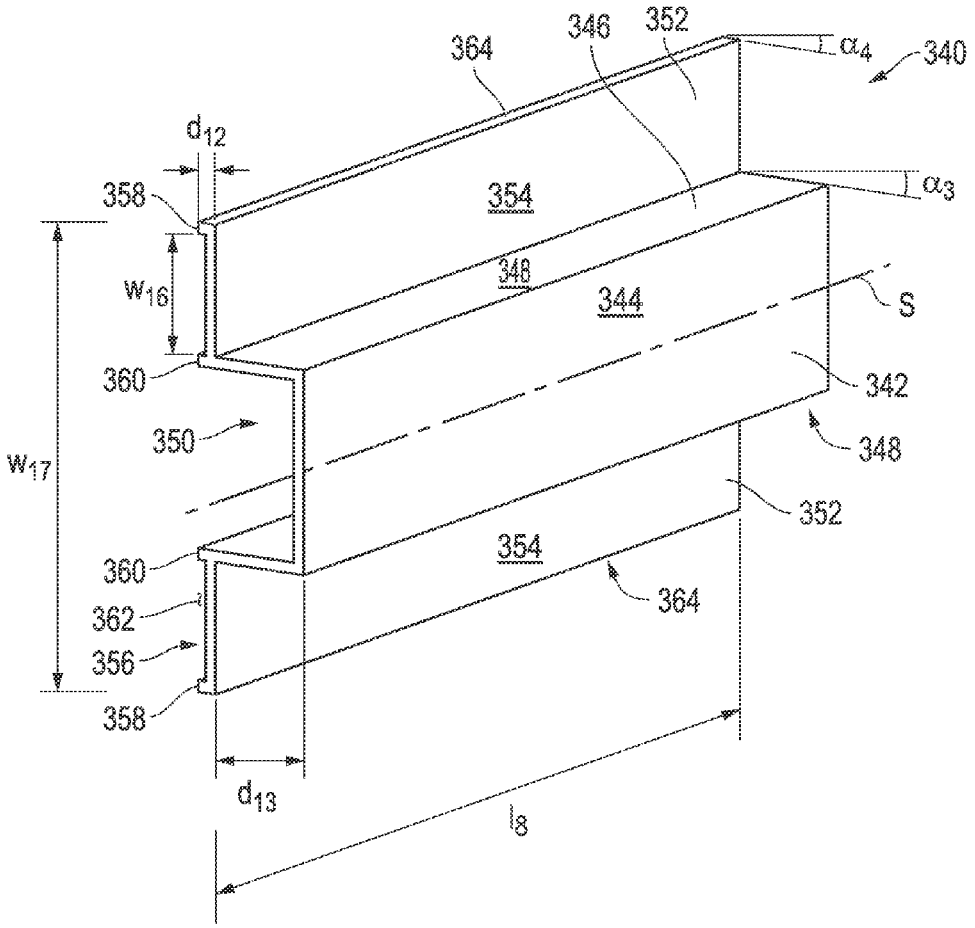
FIG. 17 is an isometric view of an improved hat channel illustrated in accordance with the first and second embodiments of the invention.

Referring to FIG. 17, a second embodiment of a horizontal element, improved hat channel 340, is provided. Improved hat channel 340 is symmetrical around line S. Improved hat channel 340 comprises elongated, planar base 342 having an exterior side 344. Exterior side 344 is configured for receiving a fastener to secure a panel of cladding or a vertical element (see FIG. 18). A pair of side walls 346 extends outward from base 342 and away from each other. Sloped outside surfaces 348 of each side wall 346 are sloped at angle $\alpha_3$, which aids in drainage of water away from exterior-insulation layer 306 (FIG. 14) or WRB layer 305 (FIG. 14A). By way of example, and not as a limitation, $\alpha_3$ may be approximately 3 degrees. Side walls 346 and base 342 define U-channel 350.

A pair of flanges 352 extends outward from each end of each side wall 346 and is parallel and offset from base 342. Each flange 352 has exterior side 354 and an opposite, interior side 356. Outside ridges 358 and inner ridges 360 are formed along interior sides 356 of flanges 352. Relief channels 362 are each defined by their respective outside ridge 358, inner ridge 360, and interior side 356. Relief channels 362 have a depth of $d_{12}$ and a width of $w_{16}$, which are configured to receive self-sealing tape 370 (FIG. 14A). More particularly, depth $d_{12}$ may be slightly less than the thickness of self-sealing tape 370, while width $w_{16}$ is slightly greater than the width of self-sealing tape 370. This allows self-sealing tape 370 to be applied to relief channel 362, and then self-sealing tape 370 is held in compression once improved hat channel 340 is secured (FIG. 16). Sloped outside surface 364 of each outside ridge 358 is sloped at angle $\alpha_4$ downward toward exterior side 354 and aids in the drainage of water away from exterior-insulation layer 306 (FIG. 14). By way of example, and not as a limitation, $\alpha_4$ may be approximately 12 degrees. Improved hat channel 340 has overall width $w_{17}$, depth $d_{13}$, and length $l_8$, which may be configured according to the needs of a particular building design and components.

Figure 18:
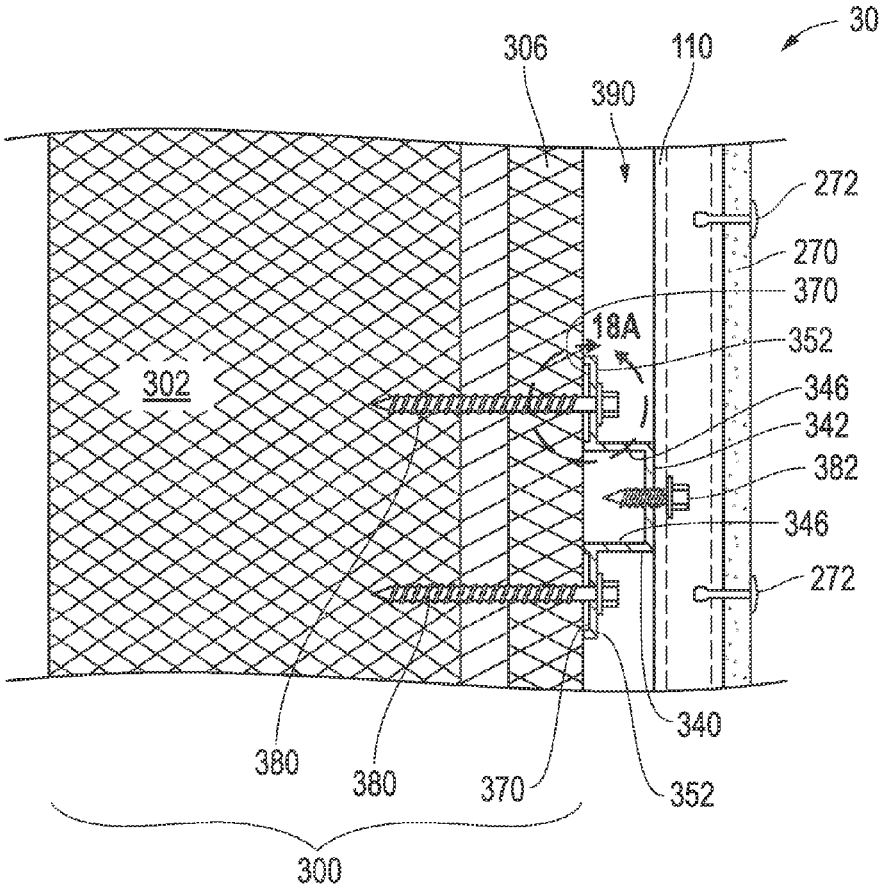
FIG. 18 is a cross-sectional, side view of the improved hat channel of FIG. 17 exemplified as installed in a structural wall in accordance with the first embodiment of the present invention.
Figure 18A:
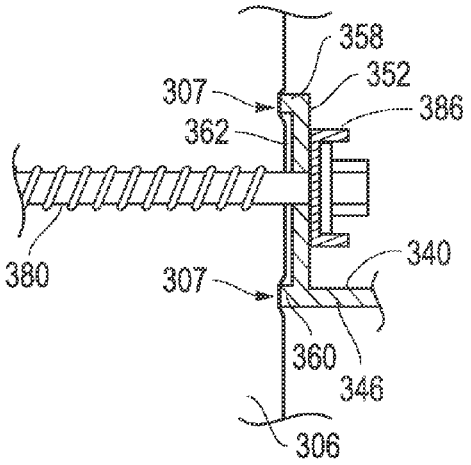
FIG. 18A is a close-up view of FIG. 18 taken along view line 18A-18A.

Referring to FIGS. 18 and 18A, improved hat channel 340 is exemplified as a horizontal element securing vertical element 110. Wall 300 comprises vertical metal stud 302. Sheathing layer 304 is secured to the exterior of metal stud 302. Optionally, a water resistant layer (not shown) may be applied to the exterior surface of sheathing 304 (see FIG. 14A). Exterior-insulation layer 306 is positioned on the exterior side of sheathing layer 304. In alternate embodiments, exterior-insulation layer 306 may be omitted (see FIG. 14A). Improved hat channel 340 is positioned horizontally such that interior sides 314 (FIG. 17) of flange 352 urges against exterior-insulation layer 306. Optionally, self-sealing tape 370 is located in each relief channel 362 (FIG. 18A) of each flange 352 and may be held in compression. First fasteners 380 extend through flanges 352, self-sealing tape 370, exterior-insulation layer 306, and sheathing layer 304, and secure into metal stud 302. Depressions 307 are formed in exterior-insulation layer 306 where ridges 358 and 360 compress exterior-insulation layer 306. These advantageously form a water-tight seal between ridges 358 and 360 and exterior-insulation layer 306, thereby sealing relief channel 362. As such, self-sealing tape 370 may be used to further ensure sealing but is not required. Shoulder washer 386 is located between flange 352 and the head of fastener 380, which provides additional thermal isolation and seals the opening formed by fastener 308 in flange 352. Vertical element 110 is positioned along exterior side 344 (FIG. 17) of base 342. Second fastener 382 extends through vertical element 110 and base 342 and secures vertical element 110 to improved hat channel 340. Panel of cladding 270 is secured to vertical element 110 using fasteners 272, which may be rivets. Ventilation cavity 390 is formed between panels of cladding 270 and the exterior surface of exterior-insulation layer 306. As such, a continuous layer of exterior insulation is provided that is unpenetrated by a framing element.

It is understood that the present invention may take many forms and embodiments. Accordingly, several variations may be made in the foregoing without departing from the spirit or the scope of the invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A sub-framing wall system for supporting exterior cladding attachable to an exterior side of a wall, comprising:
- a plurality of horizontal elements positioned horizontally on an exterior side of a wall, each of the horizontal elements comprising:
  - a board flange having an interior side and an opposite exterior side;
  - an upper ridge and a lower ridge forming a relief channel on the interior side of the board flange;
  - a setoff extending outward from the exterior side of the board flange proximate to the lower ridge and sloping downward from the board flange; and,
  - a frame flange extending vertically downward from the setoff, parallel and offset to the board flange;
- the interior side of the board flange of the horizontal elements facing the wall;
- a plurality of first fasteners extending through the board flange to fasten the horizontal elements to structural wall studs within the wall;
- a plurality of vertical elements positioned vertically on an exterior side of the horizontal elements, each of the vertical elements comprising:
  - a hat channel comprising:
    - an elongated planar base;
    - a pair of side walls extending upward from the base;
    - a latch extending inward from each of the side walls;
    - a cap seat extending above each of the latches and outward of each of the side walls; and,
    - a first and second flange extending outward of each of the cap seats;
  - a face plate securable to the hat channel, comprising:
    - an elongated, planar body having an interior and opposite exterior surface;
    - a pair of opposing side legs extending downward from the interior surface of the body; and,
    - a strike ridge extending outward from each of the side legs;
- a plurality of second fasteners extending through the base of the vertical elements and into the frame flange of the horizontal elements to fasten the vertical elements to the horizontal elements; and,
- wherein an exterior cladding element is attachable to the vertical elements by a fastener or adhesive.

2. The sub-framing system of claim 1 further comprising:
- each of the horizontal elements being fastened to two or more structural wall studs.

3. The sub-framing system of claim 2 further comprising:
- a spacing defined by a distance by which the structural wall studs are spaced apart from each other; and
- the horizontal elements being spaced apart from each other independent of the spacing between the structural wall studs.

4. The sub-framing system of claim 1 further comprising:
- the relief channel receivable of a self-sealing tape.

5. The sub-framing system of claim 1 further comprising:
- the relief channel having a depth;
- the relief channel receivable of a self-sealing tape having thickness greater than the depth of the relief channel.

6. The sub-framing system of claim 1 further comprising:
- the relief channel receivable of a self-sealing butyl tape.

7. The sub-framing system of claim 1 further comprising:
the vertical elements being spaced apart from each other independent of the spacing between the structural wall studs.

8. The sub-framing system of claim 1 further comprising:
each of the vertical elements being fastened to two or more of the horizontal elements.

9. The sub-framing system of claim 1 further comprising:
each of the horizontal elements being attached to each of the structural wall studs by a single fastener.

10. The sub-framing system of claim 1, wherein the horizontal elements and the vertical elements are fabricated from extruded aluminum.

11. The sub-framing system of claim 1, wherein the horizontal elements and the vertical elements are fabricated from 11 gauge 6000 series extruded aluminum.

12. The sub-framing system of claim 1 further comprising:
an insulation layer being located between the wall and the horizontal elements; and
the first fasteners extending through the insulation layer.

13. The sub-framing system of claim 12 further comprising:
a sheathing layer being located between the insulation layer and the structural wall studs; and
the first set of fasteners penetrate the sheathing layer.

14. The sub-framing system of claim 1 further comprising:
a water resistant-barrier layer being located between the wall and the horizontal elements; and
the first fasteners extending through the water resistant layer.

15. A multi-layered sub-framing system for supporting exterior cladding attachable to an exterior wall having an exterior insulation layer comprising:
a planar layer of horizontal elements positioned horizontally over an exterior surface of an exterior insulation layer, each of the horizontal elements comprising:
a board flange having an interior side and an opposite exterior side;
an upper ridge and a lower ridge forming a relief channel on the interior side of the board flange;
a setoff extending outward from the exterior side of the board flange proximate to the lower ridge and sloping downwardly from the board flange; and,
a frame flange extending vertically downward from the setoff, parallel and offset to the board flange;
a plurality of first fasteners extending through the horizontal elements and the exterior insulation layer to connect each of the horizontal elements to two or more structural wall studs with a wall;
a planar layer of vertical elements positioned vertically over the layer of horizontal elements;
a plurality of second fasteners extending through the horizontal elements and the vertical elements and securing the vertical elements to the horizontal elements;
wherein the insulation layer is not penetrated by the horizontal elements, the vertical elements, or the second fasteners; and,
wherein a plurality of exterior cladding panels are attachable to the vertical elements.

16. A framing element adapted for use in a sub-framing system for supporting exterior cladding attachable to an exterior side of a wall, the framing element comprising:
an elongated planar base;
a pair of side walls extending outward from the base and sloping away from each other; and,
a pair of flanges extending outward of each of the side walls and extending away from each other, each of the flanges comprising:
an interior side and an opposite exterior side, and,
an outside ridge and an inner ridge forming a relief channel on the interior side of the flange;
wherein one of the pair of flanges has an outside ridge having an upper surface being vertically downwardly sloped towards the exterior side of the one flange.

17. A framing element adapted for use in a sub-framing system for supporting exterior cladding attachable to an exterior side of an exterior insulation layer attached to a wall, the framing element comprising:
a board flange having an interior side and an opposite exterior side;
an upper ridge and a lower ridge forming a relief channel on the interior side of the board flange;
the upper ridge of the board flange having an upper surface being vertically downwardly sloped towards the exterior side of the board flange;
a setoff extending outward from the exterior side of the board flange proximate to the lower ridge and sloping downwardly from the board flange; and,
a frame flange extending vertically downward from the setoff, parallel and offset to the board flange.

* * * * *